US008555703B2

(12) United States Patent
Yonemori et al.

(10) Patent No.: US 8,555,703 B2
(45) Date of Patent: Oct. 15, 2013

(54) LEAKAGE DIAGNOSIS APPARATUS, LEAKAGE DIAGNOSIS METHOD, AND REFRIGERATION APPARATUS

(75) Inventors: Tsuyoshi Yonemori, Osaka (JP); Yoshinari Sasaki, Osaka (JP); Takahiro Yamaguchi, Osaka (JP); Manabu Yoshimi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 295 days.

(21) Appl. No.: 13/121,448

(22) PCT Filed: Sep. 24, 2009

(86) PCT No.: PCT/JP2009/004824

§ 371 (c)(1),
(2), (4) Date: Mar. 29, 2011

(87) PCT Pub. No.: WO2010/038382

PCT Pub. Date: Apr. 8, 2010

(65) Prior Publication Data

US 2011/0174059 A1 Jul. 21, 2011

(30) Foreign Application Priority Data

Sep. 30, 2008 (JP) ..... 2008-251970

(51) Int. Cl.
*G01M 3/00* (2006.01)

(52) U.S. Cl.
USPC ..... 73/40.5 R

(58) Field of Classification Search
None
See application file for complete search history.

(56) References Cited

U.S. PATENT DOCUMENTS

| | | | | |
|---|---|---|---|---|
| 5,996,364 | A | 12/1999 | Lifson et al. | |
| 6,301,912 | B1 | 10/2001 | Terai et al. | |
| 6,681,582 | B2 * | 1/2004 | Suzuki et al. | 62/129 |
| 2002/0139128 | A1 | 10/2002 | Suzuki et al. | |
| 2009/0151377 | A1 | 6/2009 | Yonemori et al. | |

FOREIGN PATENT DOCUMENTS

| | | | |
|---|---|---|---|
| CN | 1248688 | A | 3/2000 |
| CN | 1264024 | A | 8/2000 |
| JP | 58-62403 | A | 4/1983 |
| JP | 61-197970 | A | 9/1986 |
| JP | 8-128765 | A | 5/1996 |
| JP | 2000-52754 | A | 2/2000 |
| JP | 2002-364951 | A | 12/2002 |
| JP | 2006-275411 | A | 10/2006 |
| JP | 4039462 | B1 | 1/2008 |
| WO | WO 2007/108537 | A1 | 9/2007 |

* cited by examiner

*Primary Examiner* — Robert R Raevis
(74) *Attorney, Agent, or Firm* — Birch, Stewart, Kolasch & Birch, LLP.

(57) ABSTRACT

A leakage diagnosis apparatus for diagnosing presence/absence of refrigerant leakage in a refrigerant circuit performing a refrigeration cycle, wherein refrigerant leakage diagnosis using the amount of refrigerant exergy loss in a circuit component of the refrigerant circuit is realized. In a leakage diagnosis apparatus, an exergy calculation section calculates a leakage index value which changes in accordance with the amount of refrigerant leaking out of a refrigerant circuit based on the amount of refrigerant exergy loss in the circuit component. Then, a leakage determination section determines whether there is refrigerant leakage in the refrigerant circuit based on the leakage index value calculated by the exergy calculation section.

6 Claims, 9 Drawing Sheets

(A) REFERENCE STATE (B) FIRST PROGRESSIVE STATE (A) REFERENCE STATE (B) SECOND PROGRESSIVE STATE (A) REFERENCE STATE (B) FIRST PROGRESSIVE STATE (A) REFERENCE STATE (B) SECOND PROGRESSIVE STATE

LEAKAGE DIAGNOSIS APPARATUS, LEAKAGE DIAGNOSIS METHOD, AND REFRIGERATION APPARATUS

TECHNICAL FIELD

The present invention relates to a leakage diagnosis apparatus and a leakage diagnosis method for diagnosing presence/absence of leakage of refrigerant from a refrigerant circuit, and a refrigeration apparatus including a leakage diagnosis apparatus.

BACKGROUND ART

Leakage diagnosis apparatuses for diagnosing presence/absence of refrigerant leakage from refrigerant circuits have been known in the art. For example, Patent Document 1 describes an abnormality detection system as a leakage diagnosis apparatus of this type. The abnormality detection system is configured to detect refrigerant leakage using the degree of subcooling, the degree of superheat, the low-pressure and the high-pressure of the refrigeration cycle of the air conditioner apparatus, the outdoor temperature, the indoor temperature and the compressor rotational speed.

Patent Document 2 describes an analysis apparatus of a refrigeration apparatus for diagnosing failure of circuit components of a refrigerant circuit (e.g., the compressor) by analyzing the exergy of refrigerant in the circuit components.

CITATION LIST

Patent Document

PATENT DOCUMENT 1: Japanese Laid-Open Patent Publication No. 2006-275411

PATENT DOCUMENT 2: Japanese Patent No. 4039462

SUMMARY OF THE INVENTION

Technical Problem

Incidentally, proposals have been made in the art to detect refrigerant leakage using an index value in accordance with the amount of refrigerant leaking out of the refrigerant circuit. However, it was not known that the index value can be calculated from the amount of refrigerant exergy loss in a circuit component provided in the refrigerant circuit. Thus, no one had conceived using the amount of refrigerant exergy loss in a circuit component for diagnosing the presence/absence of refrigerant leakage in the refrigerant circuit.

The present invention has been made in view of the above, and an object thereof is to provide a leakage diagnosis apparatus for diagnosing the presence/absence of refrigerant leakage in the refrigerant circuit performing a refrigeration cycle, wherein refrigerant leakage diagnosis using the amount of refrigerant exergy loss in a circuit component of the refrigerant circuit is realized.

Solution to the Problem

A first aspect is directed to a leakage diagnosis apparatus (50) for diagnosing presence/absence of refrigerant leakage in a refrigerant circuit (20) including a compressor (30), a radiator (34, 37), a depressurization mechanism (36) and an evaporator (34, 37) provided as circuit components thereof and performing a refrigeration cycle by circulating refrigerant therethrough. The leakage diagnosis apparatus (50) includes: index value calculation means (31) for calculating a leakage index value which changes in accordance with an amount of refrigerant leaking out of the refrigerant circuit (20) based on an amount of refrigerant exergy loss in a circuit component; and leakage determination means (53) for determining whether there is refrigerant leakage in the refrigerant circuit (20) based on the leakage index value calculated by the index value calculation means (31).

In the first aspect, the leakage index value which changes in accordance with the amount of refrigerant leaking out of the refrigerant circuit (20) is calculated based on the amount of refrigerant exergy loss in a circuit component such as the radiator (34, 37), for example. Then, it is determined whether there is refrigerant leakage in the refrigerant circuit (20) based on the leakage index value. Here, when there is refrigerant leakage in the refrigerant circuit (20), there appears a predetermined change in the amount of refrigerant exergy loss in the circuit component. Therefore, it is possible to calculate the leakage index value which changes in accordance with the amount of refrigerant leaking out of the refrigerant circuit (20) by using the amount of refrigerant exergy loss in the circuit component. The leakage index value undergoes a predetermined change when there is refrigerant leakage. Therefore, in the first aspect, a leakage index value which undergoes a predetermined change when there is refrigerant leakage in the refrigerant circuit (20) is calculated based on the amount of refrigerant exergy loss in the circuit component, and refrigerant leakage diagnosis is performed based on the leakage index value.

Note that "exergy" is the maximum work that can be converted to mechanical energy when a substance at a certain pressure and temperature is allowed to transition to the environmental state, and is referred to also as "available energy." The amount of refrigerant exergy loss in a circuit component is "the energy to be needed in that circuit component in an actual refrigeration cycle in excess of that in a theoretical cycle (reverse Carnot cycle)," and means "the amount of exergy to be lost in that circuit component in an actual refrigeration cycle." "Amount of exergy loss" may be expressed also as "exergy loss." The amount of refrigerant exergy loss in a circuit component will be described in detail.

In a compression process of a theoretical cycle, adiabatic compression is performed and the entropy of the refrigerant is constant. On the other hand, with the actual compressor (30), an excess of energy is needed as compared with the theoretical cycle because there is loss due to mechanical friction and because heat goes in and out of refrigerant. The amount of refrigerant exergy loss in the compressor (30) corresponds to the excess of energy to be needed as compared with the theoretical cycle, and is representing the magnitude of loss occurring in the compressor (30).

In a heat dissipation process of a theoretical cycle, the temperature and the pressure of the refrigerant are constant. On the other hand, with the practical radiator (34, 37), refrigerant exchanges heat with a fluid such as the air, for example, with a temperature difference therebetween, and also there is frictional loss occurring in the pipeline, thereby requiring an excess of energy as compared with the theoretical cycle. The amount of refrigerant exergy loss in the radiator (34, 37) corresponds to the excess of energy to be needed as compared with the theoretical cycle, and is representing the magnitude of loss occurring in the radiator (34, 37).

In an evaporation process of a theoretical cycle, the temperature and the pressure of the refrigerant are constant. On the other hand, with the practical evaporator (34, 37), refrigerant exchanges heat with a fluid such as the air, for example, with a temperature difference therebetween, and also there is frictional loss occurring in the pipeline, thereby requiring an excess of energy as compared with the theoretical cycle. The amount of refrigerant exergy loss in the evaporator (34, 37) corresponds to the excess of energy to be needed as compared with the theoretical cycle, and is representing the magnitude of loss occurring in the evaporator (34, 37).

In an expansion process of a theoretical cycle, adiabatic expansion is performed and the entropy of the refrigerant is constant. On the other hand, with the actual depressurization mechanism (36), an excess of energy is needed as compared with the theoretical cycle because there is frictional loss. The amount of refrigerant exergy loss in the depressurization mechanism (36) corresponds to the excess of energy to be needed as compared with the theoretical cycle, and is representing the magnitude of loss occurring in the depressurization mechanism (36).

A second aspect is the first aspect, wherein the index value calculation means (31) calculates, as the leakage index value, a radiator-side index value based on an amount of refrigerant exergy loss in the radiator (34, 37), and the leakage determination means (53) determines whether there is refrigerant leakage in the refrigerant circuit (20) based on the radiator-side index value.

In the second aspect, the radiator-side index value is calculated, as the leakage index value, based on the amount of refrigerant exergy loss in the radiator (34, 37). Here, when there is refrigerant leakage in the refrigerant circuit (20), the amount of refrigerant exergy loss in the radiator (34, 37) decreases along with a decrease in the high pressure of the refrigeration cycle. That is, when there is refrigerant leakage, there appears a predetermined change in the amount of refrigerant exergy loss in the radiator (34, 37). Therefore, refrigerant leakage diagnosis is performed based on the radiator-side index value which is calculated based on the amount of refrigerant exergy loss in the radiator (34, 37).

A third aspect is the second aspect, wherein gas refrigerant is cooled and condensed in the radiator (34, 37), and the index value calculation means (31) calculates the radiator-side index value without using an amount of exergy loss during a process in which the refrigerant is in a single-phase gas state in the radiator (34, 37).

In the third aspect, the radiator-side index value is calculated without using the amount of exergy loss during the process in which the refrigerant is in a single-phase gas state in the radiator (34, 37).

A fourth aspect is the third aspect, wherein the index value calculation means (31) calculates, as the radiator-side index value, a ratio of one of an amount of exergy loss during a process in which the refrigerant is in a two-phase gas/liquid state in the radiator (34, 37) and an amount of exergy loss during a process in which the refrigerant is in a single-phase liquid state in the radiator (34, 37) with respect to the other.

In the fourth aspect, the ratio of one of "the amount of exergy loss during the process in which the refrigerant is in a two-phase gas/liquid state in the radiator (34, 37)" and "the amount of exergy loss during the process in which the refrigerant is in a single-phase liquid state in the radiator (34, 37)" with respect to the other is calculated as the radiator-side index value. Here, when there is refrigerant leakage in the refrigerant circuit (20), "the amount of exergy loss during the process in which the refrigerant is in a two-phase gas/liquid state in the radiator (34, 37)" and "the amount of exergy loss during the process in which the refrigerant is in a single-phase liquid state in the radiator (34, 37)" each decrease along with a decrease in the high pressure of the refrigeration cycle. Since the difference between the condensation temperature of the refrigerant in the radiator (34, 37) and the temperature of the fluid which exchanges heat with the refrigerant in the radiator (34, 37) (e.g., the temperature of the outdoor air) decreases, the degree of subcooling of the refrigerant flowing out of the radiator (34, 37) decreases. Therefore, between "the amount of exergy loss during the process in which the refrigerant is in a two-phase gas/liquid state in the radiator (34, 37)" and "the amount of exergy loss during the process in which the refrigerant is in a single-phase liquid state in the radiator (34, 37)," particularly the latter decreases significantly. Therefore, when there is refrigerant leakage, there appears a predetermined change in the radiator-side index value. Thus, the ratio of one of "the amount of exergy loss during the process in which the refrigerant is in a two-phase gas/liquid state in the radiator (34, 37)" and "the amount of exergy loss during the process in which the refrigerant is in a single-phase liquid state in the radiator (34, 37)" with respect to the other is used as the radiator-side index value and refrigerant leakage diagnosis is performed based on the radiator-side index value.

A fifth aspect is the fourth aspect, wherein in the refrigerant circuit (20), the depressurization mechanism (36) is formed by an expansion valve (36) whose degree of opening is variable, and the degree of opening of the expansion valve (36) is adjusted so that a degree of subcooling of the refrigerant flowing out of the radiator (34, 37) is constant, and the leakage determination means (53) determines that there is refrigerant leakage in the refrigerant circuit (20) when the degree of opening of the expansion valve (36) is less than or equal to a predetermined judgment degree of opening even if it cannot be determined that there is refrigerant leakage in the refrigerant circuit (20) based on the radiator-side index value.

In the fifth aspect, it is determined that there is refrigerant leakage when the degree of opening of the expansion valve (36) is less than or equal to a judgment degree of opening even if it cannot be determined that there is refrigerant leakage based on the radiator-side index value. Here, where the degree of opening of the expansion valve (36) is adjusted so that the degree of subcooling of the refrigerant flowing out of the radiator (34, 37) is constant, the degree of subcooling of the refrigerant flowing out of the radiator (34, 37) does not change substantially in a state where the amount of refrigerant which has leaked from the refrigerant circuit (20) is relatively small. Therefore, the ratio of one of "the amount of exergy loss during the process in which the refrigerant is in a two-phase gas/liquid state in the radiator (34, 37)" and "the amount of exergy loss during the process in which the refrigerant is in a single-phase liquid state in the radiator (34, 37)" with respect to the other does not change substantially. That is, the radiator-side index value does not change substantially. On the other hand, when refrigerant flowing through the radiator (34, 37) decreases due to refrigerant leakage, the degree of opening of the expansion valve (36) decreases so that the degree of subcooling of the refrigerant flowing out of the radiator (34, 37) does not decrease. When there is refrigerant leakage, there appears a change in the degree of opening of the expansion valve (36) earlier than in the radiator-side index value. The fifth aspect focuses on this point, and determines that there is refrigerant leakage when the degree of opening of the expansion valve (36) is less than or equal to a judgment degree of opening even if it cannot be determined that there is refrigerant leakage based on the radiator-side index value.

A sixth aspect is the second or third aspect, wherein the index value calculation means (31) calculates, as the radiator-side index value, a ratio of one of an amount of refrigerant exergy loss in the radiator (34, 37) and an amount of heat dissipation from the refrigerant in the radiator (34, 37) with respect to the other.

In the sixth aspect, the ratio of one of "the amount of refrigerant exergy loss in the radiator (34, 37)" and "the amount of heat dissipation from the refrigerant in the radiator (34, 37)" with respect to the other is calculated as the radiator-side index value. Here, when there is refrigerant leakage in the refrigerant circuit (20), "the amount of refrigerant exergy loss in the radiator (34, 37)" and "the amount of heat dissipation from the refrigerant in the radiator (34, 37)" decrease by substantially the same amount along with a decrease in the high pressure of the refrigeration cycle. The latter is quite a larger value than the former. Therefore, when there is refrigerant leakage, there appears a predetermined change in the radiator-side index value. Thus, the ratio of one of "the amount of refrigerant exergy loss in the radiator (34, 37)" and "the amount of heat dissipation from the refrigerant in the radiator (34, 37)" with respect to the other is used as the radiator-side index value and refrigerant leakage diagnosis is performed based on the radiator-side index value.

A seventh aspect is the second or third aspect, wherein the index value calculation means (31) calculates, as the radiator-side index value, a ratio of one of an amount of refrigerant exergy loss in the radiator (34, 37) and an input to the compressor (30) with respect to the other.

In the seventh aspect, the ratio of one of "the amount of refrigerant exergy loss in the radiator (34, 37)" and "the input to the compressor (30)" with respect to the other is calculated as the radiator-side index value. Here, when there is refrigerant leakage in the refrigerant circuit (20), "the amount of refrigerant exergy loss in the radiator (34, 37)" and "the input to the compressor (30)" decrease by substantially the same amount along with a decrease in the high pressure of the refrigeration cycle. The latter is quite a larger value than the former. Therefore, when there is refrigerant leakage, there appears a predetermined change in the radiator-side index value. Therefore, the ratio of one of "the amount of refrigerant exergy loss in the radiator (34, 37)" and "the input to the compressor (30)" with respect to the other is used as the radiator-side index value and refrigerant leakage diagnosis is performed based on the radiator-side index value.

An eighth aspect is one of the second to seventh aspects, wherein the refrigerant circuit (20) is controlled so that a low pressure of the refrigeration cycle is constant, the index value calculation means (31) calculates an evaporator-side index value based on an amount of refrigerant exergy loss in the evaporator (34, 37), and the leakage determination means (53) determines whether the refrigerant leakage in the refrigerant circuit (20) has progressed to a predetermined level based on the evaporator-side index value.

In the eighth aspect, it is determined whether there is refrigerant leakage in the refrigerant circuit (20) based on the radiator-side index value, and it is determined whether the refrigerant leakage in the refrigerant circuit (20) has progressed to a predetermined level based on the evaporator-side index value. Here, where the refrigerant circuit (20) is controlled so that the low pressure of the refrigeration cycle is constant, there is a relatively substantial change in the amount of refrigerant exergy loss in the radiator (34, 37) whereas the amount of refrigerant exergy loss in the evaporator (34, 37) does not change substantially in a state where the amount of refrigerant which has leaked from the refrigerant circuit (20) is relatively small. However, when the amount of refrigerant which has leaked from the refrigerant circuit (20) is relatively large, there is a relatively substantial change in the amount of refrigerant exergy loss in the evaporator (34, 37). The eighth aspect focuses on this point, and determines whether there is refrigerant leakage in the refrigerant circuit (20) based on the radiator-side index value, and determines whether the refrigerant leakage in the refrigerant circuit (20) has progressed to a predetermined level based on the evaporator-side index value.

A ninth aspect is the first aspect, wherein the index value calculation means (31) calculates, as the leakage index value, an evaporator-side index value based on an amount of refrigerant exergy loss in the evaporator (34, 37), and the leakage determination means (53) determines whether there is refrigerant leakage in the refrigerant circuit (20) based on the evaporator-side index value.

In the ninth aspect, the evaporator-side index value is calculated, as the leakage index value, based on the amount of refrigerant exergy loss in the evaporator (34, 37). Here, when there is refrigerant leakage in the refrigerant circuit (20), the amount of refrigerant exergy loss in the evaporator (34, 37) decreases along with a decrease in the low pressure of the refrigeration cycle. That is, when there is refrigerant leakage, there appears a predetermined change in the amount of refrigerant exergy loss in the evaporator (34, 37). Therefore, refrigerant leakage diagnosis is performed based on the evaporator-side index value which is calculated based on the amount of refrigerant exergy loss in the evaporator (34, 37).

A tenth aspect is the ninth aspect, wherein the index value calculation means (31) calculates, as the evaporator-side index value, a ratio of one of an amount of exergy loss during a process in which a refrigerant is in a two-phase gas/liquid state in the evaporator (34, 37) and an amount of exergy loss during a process in which the refrigerant is in a single-phase gas state in the evaporator (34, 37) with respect to the other.

In the tenth aspect, the ratio of one of "the amount of exergy loss during the process in which the refrigerant is in a two-phase gas/liquid state in the evaporator (34, 37)" and "the amount of exergy loss during the process in which the refrigerant is in a single-phase gas state in the evaporator (34, 37)" with respect to the other is calculated as the evaporator-side index value. Here, when there is refrigerant leakage in the refrigerant circuit (20), the degree of superheat of the refrigerant flowing out of the evaporator (34, 37) increases, and "the amount of exergy loss during the process in which the refrigerant is in a single-phase gas state in the evaporator (34, 37)" increases accordingly. On the other hand, "the amount of exergy loss during the process in which the refrigerant is in a two-phase gas/liquid state in the evaporator (34, 37)" does not change substantially. Therefore, when there is refrigerant leakage, there appears a predetermined change in the radiator-side index value. Therefore, the ratio of one of "the amount of exergy loss during the process in which the refrigerant is in a two-phase gas/liquid state in the evaporator (34, 37)" and "the amount of exergy loss during the process in which the refrigerant is in a single-phase gas state in the evaporator (34, 37)" with respect to the other is used as the evaporator-side index value, and refrigerant leakage diagnosis is performed based on the evaporator-side index value.

An eleventh aspect is the tenth aspect, wherein in the refrigerant circuit (20), the depressurization mechanism (36) is formed by an expansion valve (36) whose degree of opening is variable, and the degree of opening of the expansion valve (36) is adjusted so that a degree of superheat of the refrigerant flowing out of the evaporator (34, 37) is constant, and the leakage determination means (53) determines that there is refrigerant leakage in the refrigerant circuit (20) when the degree of opening of the expansion valve (36) is greater than or equal to a predetermined judgment degree of opening even if it cannot be determined that there is refrigerant leakage in the refrigerant circuit (20) based on the evaporator-side index value.

In the eleventh aspect, it is determined that there is refrigerant leakage when the degree of opening of the expansion valve (36) is greater than or equal to a judgment degree of opening even if it cannot be determined that there is refrigerant leakage based on the evaporator-side index value. Here, where the degree of opening of the expansion valve (36) is adjusted so that the degree of superheat of the refrigerant flowing out of the evaporator (34, 37) is constant, the degree of superheat of the refrigerant flowing out of the evaporator (34, 37) does not change substantially in a state where the amount of refrigerant which has leaked from the refrigerant circuit (20) is relatively small. Therefore, the ratio of one of "the amount of exergy loss during the process in which the refrigerant is in a two-phase gas/liquid state in the evaporator (34, 37)" and "the amount of exergy loss during the process in which the refrigerant is in a single-phase gas state in the evaporator (34, 37)" with respect to the other does not change substantially. That is, the evaporator-side index value does not change substantially. On the other hand, when the refrigerant flowing through the evaporator (34, 37) decreases due to refrigerant leakage, the degree of opening of the expansion valve (36) increases so that the degree of superheat of the refrigerant flowing out of the evaporator (34, 37) does not increase. When there is refrigerant leakage, there appears a change in the degree of opening of the expansion valve (36) earlier than in the evaporator-side index value. The eleventh aspect focuses on this point, and determines that there is refrigerant leakage when the degree of opening of the expansion valve (36) is greater than or equal to a judgment degree of opening even if it cannot be determined that there is refrigerant leakage based on the evaporator-side index value.

A twelfth aspect is the first aspect, wherein the index value calculation means (31) calculates, as the leakage index value, a compressor-side index value based on an amount of refrigerant exergy loss in the compressor (30), and the leakage determination means (53) determines whether there is refrigerant leakage in the refrigerant circuit (20) based on the compressor-side index value.

In the twelfth aspect, the compressor-side index value is calculated, as the leakage index value, based on the amount of refrigerant exergy loss in the compressor (30). Here, when there is refrigerant leakage in the refrigerant circuit (20), the amount of refrigerant exergy loss in the compressor (30) increases along with an increase in the degree of superheat of the refrigerant sucked into the compressor (30). That is, when there is refrigerant leakage, there appears a predetermined change in the amount of refrigerant exergy loss in the compressor (30). Therefore, refrigerant leakage diagnosis is performed based on the compressor-side index value which is calculated based on the amount of refrigerant exergy loss in the compressor (30).

A thirteenth aspect is the first aspect, wherein the index value calculation means (31) calculates, as the leakage index value, a ratio of one of an amount of refrigerant exergy loss in the radiator (34, 37) and an amount of refrigerant exergy loss in the evaporator (34, 37) with respect to the other.

In the thirteenth aspect, the ratio of one of "the amount of refrigerant exergy loss in the radiator (34, 37)" and "the amount of refrigerant exergy loss in the evaporator (34, 37)" with respect to the other is calculated as the leakage index value. Here, where the refrigerant circuit (20) is controlled so that the low pressure of the refrigeration cycle is constant, for example, the amount of refrigerant exergy loss in the radiator (34, 37) decreases along with a decrease in the high pressure of the refrigeration cycle whereas the amount of refrigerant exergy loss in the evaporator (34, 37) does not change substantially when there is refrigerant leakage. Thus, there appears a predetermined change in the leakage index value. Also in a case where the refrigerant circuit (20) is controlled so that the high pressure of the refrigeration cycle is constant, for example, there appears a predetermined change in the leakage index value when there is refrigerant leakage. Therefore, the ratio of one of "the amount of refrigerant exergy loss in the radiator (34, 37)" and "the amount of refrigerant exergy loss in the evaporator (34, 37)" with respect to the other is used as the leakage index value, and refrigerant leakage diagnosis is performed based on the leakage index value.

A fourteenth aspect is one of the first to thirteenth aspects, wherein an accumulator (38) for separating liquid refrigerant from refrigerant sucked into the compressor (30) is provided in the refrigerant circuit (20), and the leakage determination means (53) does not determine that there is refrigerant leakage in the refrigerant circuit (20) when a difference between a degree of superheat of the refrigerant flowing into the accumulator (38) and a degree of superheat of the refrigerant flowing out of the accumulator (38) is greater than or equal to a predetermined suction-side reference value even if it can be determined that there is refrigerant leakage in the refrigerant circuit (20) based on the leakage index value.

In the fourteenth aspect, it is not determined that there is refrigerant leakage when the difference between the degree of superheat of the refrigerant flowing into the accumulator (38) and the degree of superheat of the refrigerant flowing out of the accumulator (38) is greater than or equal to a suction-side reference value even if it can be determined that there is refrigerant leakage based on the leakage index value. In a case where the difference between the degree of superheat at the inlet of the accumulator (38) and that at the outlet thereof is greater than or equal to the suction-side reference value, a relatively large amount of refrigerant is accumulated in the accumulator (38). In the fourteenth aspect, it is not determined that there is refrigerant leakage when a relatively large amount of refrigerant is accumulated in the accumulator (38) even if it can be determined that there is refrigerant leakage based on the leakage index value.

A fifteenth aspect is directed to a leakage diagnosis apparatus (50) for diagnosing presence/absence of refrigerant leakage in a refrigerant circuit (20) including a compressor (30), a radiator (34, 37), a depressurization mechanism (36) and an evaporator (34, 37) provided as circuit components thereof and performing a refrigeration cycle by circulating refrigerant therethrough. The leakage diagnosis apparatus (50) includes: index value calculation means (31) for calculating a leakage index value which changes in accordance with an amount of refrigerant leaking out of the refrigerant circuit (20) based on an amount of refrigerant exergy loss in a circuit component; and display means (56) for displaying information for leakage diagnosis based on the leakage index value calculated by the index value calculation means (31).

In the fifteenth aspect, the leakage index value which changes in accordance with the amount of refrigerant leaking out of the refrigerant circuit (20) is calculated based on the amount of refrigerant exergy loss in a circuit component. Then, the information for leakage diagnosis based on the leakage index value is displayed on the display means (56). Thus, refrigerant leakage diagnosis can be performed by a person who sees the information for leakage diagnosis displayed on the display means (56).

A sixteenth aspect is a refrigeration apparatus (10), including: a refrigerant circuit (20) including a compressor (30), a radiator (34, 37), a depressurization mechanism (36) and an evaporator (34, 37) provided as circuit components thereof and performing a refrigeration cycle by circulating refrigerant therethrough; and a leakage diagnosis apparatus (50) of one of the first to fifteenth aspects.

In the sixteenth aspect, the refrigeration apparatus (10) includes the leakage diagnosis apparatus (50) for calculating the leakage index value using the amount of refrigerant exergy loss in a circuit component.

A seventeenth aspect is directed to a leakage diagnosis method for diagnosing presence/absence of refrigerant leakage in a refrigerant circuit (20) including a compressor (30), a radiator (34, 37), a depressurization mechanism (36) and an evaporator (34, 37) provided as circuit components thereof and performing a refrigeration cycle by circulating refrigerant therethrough. The leakage diagnosis method includes: an index value calculation step of calculating a leakage index value which changes in accordance with an amount of refrigerant leaking out of the refrigerant circuit (20) based on an amount of refrigerant exergy loss in a circuit component; and a leakage determination step of determining whether there is refrigerant leakage in the refrigerant circuit (20) based on the leakage index value calculated by the index value calculation step.

In the seventeenth aspect, the leakage index value which changes in accordance with the amount of refrigerant leaking out of the refrigerant circuit (20) is calculated using the amount of refrigerant exergy loss in a circuit component such as the radiator (34, 37), for example. Then, it is determined whether there is refrigerant leakage in the refrigerant circuit (20) based on the leakage index value. In the seventeenth aspect, a leakage index value which undergoes a predetermined change when there is refrigerant leakage in the refrigerant circuit (20) is calculated using the amount of refrigerant exergy loss in a circuit component, and refrigerant leakage diagnosis is performed based on the leakage index value.

Advantages of the Invention

In the present invention, a leakage index value which undergoes a predetermined change when there is refrigerant leakage in the refrigerant circuit (20) is calculated based on the amount of refrigerant exergy loss in a circuit component, and refrigerant leakage diagnosis is performed based on the leakage index value. The refrigerant leakage in the refrigerant circuit (20) can be detected, for example, by monitoring the change in the leakage index value. Therefore, it is possible to realize refrigerant leakage diagnosis using the amount of refrigerant exergy loss in a circuit component of the refrigerant circuit (20).

In the second aspect, since there appears a predetermined change in the amount of refrigerant exergy loss in the radiator (34, 37) when there is refrigerant leakage in the refrigerant circuit (20), refrigerant leakage diagnosis is performed based on the radiator-side index value which is calculated based on the amount of refrigerant exergy loss in the radiator (34, 37). Therefore, it is possible to realize refrigerant leakage diagnosis using the amount of refrigerant exergy loss in the radiator (34, 37).

In the second aspect, where the refrigerant circuit (20) is controlled so that the low pressure of the refrigeration cycle is constant, for example, a somewhat significant change appears in the amount of refrigerant exergy loss in the radiator (34, 37) even in a state where the amount of refrigerant which has leaked from the refrigerant circuit (20) is relatively small. Here, while conventional leakage detection methods can detect a state where refrigerant leakage has progressed to a certain degree, they cannot detect a state where the degree of refrigerant leakage is small because the physical quantity used for the detection of refrigerant leakage (e.g., the low-pressure of the refrigeration cycle) does not change substantially in a state where the degree of refrigerant leakage is small. Therefore, a certain amount of refrigerant leaks from the refrigerant circuit (20), which may have impact not only on the state of the circuit component but also on the global environment in a case where fluorocarbon refrigerant is used, for example. In contrast, in the second aspect, since "the amount of refrigerant exergy loss in the radiator (34, 37)" is used in which a somewhat significant change appears even in a state where the amount of refrigerant which has leaked from the refrigerant circuit (20) is relatively small, it is possible to detect refrigerant leakage at a stage where the amount of refrigerant which has leaked from the refrigerant circuit (20) is still relatively small. Therefore, it is possible to reduce the amount of refrigerant leaking from the refrigerant circuit (20), and to reduce the impact on the global environment in a case where refrigerant that has impact on the global environment is used.

In the third aspect, the radiator-side index value is calculated without using the amount of exergy loss during the process in which the refrigerant is in a single-phase gas state in the radiator (34, 37). Here, the amount of refrigerant exergy loss in the entire radiator (34, 37) is represented by the area of the region (c) in FIG. 2. When the radiator-side index value is calculated based on the amount of refrigerant exergy loss in the entire radiator (34, 37), it is necessary to calculate the area of the region (c). In order to calculate the area of the region (c), the coordinate values of Point B in FIG. 2 are needed. The coordinate values of Point B are the temperature and the entropy of the refrigerant after the completion of the compression process in the compressor (30). However, it is difficult to provide a sensor at the outlet of the compression chamber of the compressor (30). Since the temperature of the refrigerant discharged from the compression chamber decreases by the time it reaches a discharge pipe (40), it is not possible to accurately detect the temperature and the entropy of the refrigerant after the completion of the compression process even by using a temperature sensor provided at the discharge pipe (40) of the compressor (30). Therefore, where the radiator-side index value is calculated based on the amount of refrigerant exergy loss in the entire radiator (34, 37), the radiator-side index value will not be an accurate value due to errors in the coordinate values of Point B. In contrast, in the third aspect, the radiator-side index value is calculated without using the amount of exergy loss during the process in which the refrigerant is in a single-phase gas state in the radiator (34, 37), and therefore the temperature and the entropy of the refrigerant after the completion of the compression process are not needed for the calculation of the radiator-side index value. Therefore, it is possible to calculate the radiator-side index value using only those values that are relatively accurate.

In the fourth aspect, since there appears a predetermined change in the ratio of one of "the amount of exergy loss during the process in which the refrigerant is in a two-phase gas/liquid state in the radiator (34, 37)" and "the amount of exergy loss during the process in which the refrigerant is in a single-phase liquid state in the radiator (34, 37)" with respect to the other when there is refrigerant leakage in the refrigerant circuit (20), this ratio is used as the radiator-side index value and refrigerant leakage diagnosis is performed based on the radiator-side index value. The radiator-side index value is a ratio between amounts of exergy loss, and therefore is a normalized value. Here, if one compares the amount of refrigerant exergy loss in the same circuit component between refrigerant circuits (20) of different rated capacities, there will be a difference between the values even if the comparison is made under the same operating conditions. Therefore, where the leakage index value is not normalized, it is necessary to perform refrigerant leakage diagnosis while taking into consideration the rated capacity of the refrigerant circuit (20). In contrast, in the fourth aspect, since the radiator-side index value is normalized, there will be no substantial difference in the radiator-side index value between refrigerant circuits (20) of different rated capacities. Therefore, it is possible to perform refrigerant leakage diagnosis without taking into consideration the rated capacity of the refrigerant circuit (20). Where it is determined whether there is refrigerant leakage by comparing the radiator-side index value with a predetermined reference value, for example, it is possible to perform refrigerant leakage diagnosis using a common reference value between refrigerant circuits (20) of different rated capacities.

In the fifth aspect, where the degree of opening of the expansion valve (36) is adjusted so that the degree of subcooling of the refrigerant flowing out of the radiator (34, 37) is constant, there appears a change in the degree of opening of the expansion valve (36) earlier than in the radiator-side index value when there is refrigerant leakage, and therefore it is determined that there is refrigerant leakage when the degree of opening of the expansion valve (36) is less than or equal to a judgment degree of opening. Therefore, it is possible to detect refrigerant leakage at a stage where the amount of refrigerant which has leaked from the refrigerant circuit (20) is still small.

In the sixth aspect, since there appears a predetermined change in the ratio of one of "the amount of refrigerant exergy loss in the radiator (34, 37)" and "the amount of heat dissipation from the refrigerant in the radiator (34, 37)" with respect to the other when there is refrigerant leakage in the refrigerant circuit (20), the ratio is used as the radiator-side index value and refrigerant leakage diagnosis is performed based on the radiator-side index value. As in the fourth aspect, the radiator-side index value is a ratio between amounts of exergy loss, and therefore is a normalized value. Therefore, it is possible to perform refrigerant leakage diagnosis without taking into consideration the rated capacity of the refrigerant circuit (20).

In the sixth aspect, "the amount of heat dissipation from the refrigerant in the radiator (34, 37)" is a value that reflects the operation state of the refrigerant circuit (20) (e.g., the amount of refrigerant circulating). Here, the amount of refrigerant exergy loss in the radiator (34, 37) changes not only when there is refrigerant leakage, but also depending on the operation state of the refrigerant circuit (20) (e.g., the amount of refrigerant circulating). Therefore, where the amount of refrigerant exergy loss in the radiator (34, 37) is used, as it is, for refrigerant leakage diagnosis, it is necessary to take into consideration the operation state of the refrigerant circuit (20). Where refrigerant leakage diagnosis is performed by comparing the radiator-side index value with a predetermined reference value, for example, it is necessary to reproduce the operation state of the refrigerant circuit (20) at the time when the reference value was determined, and to compare the radiator-side index value in that state with the reference value. In contrast, in the sixth aspect, since a radiator-side index value that reflects the operation state of the refrigerant circuit (20) is used, it is possible to perform refrigerant leakage diagnosis without so much taking into consideration the operation state of the refrigerant circuit (20).

In the seventh aspect, since there appears a predetermined change in the ratio of one of "the amount of refrigerant exergy loss in the radiator (34, 37)" and "the input to the compressor (30)" with respect to the other when there is refrigerant leakage in the refrigerant circuit (20), the ratio is used as the radiator-side index value and refrigerant leakage diagnosis is performed based on the radiator-side index value. As in the fourth aspect, the radiator-side index value is a ratio between amounts of exergy loss, and therefore is a normalized value. Therefore, it is possible to perform refrigerant leakage diagnosis without taking into consideration the rated capacity of the refrigerant circuit (20).

In the seventh aspect, "the input to the compressor (30)" is a value that reflects the operation state of the refrigerant circuit (20) (e.g., the amount of refrigerant circulating). The radiator-side index value which reflects the operation state of the refrigerant circuit (20) is used for refrigerant leakage diagnosis. Therefore, as in the sixth aspect, it is possible to perform refrigerant leakage diagnosis without so much taking into consideration the operation state of the refrigerant circuit (20).

In the eighth aspect, it is determined whether there is refrigerant leakage in the refrigerant circuit (20) based on the radiator-side index value, and it is determined whether the refrigerant leakage in the refrigerant circuit (20) has progressed to a predetermined level based on the evaporator-side index value. Therefore, it is possible to detect not only whether there is refrigerant leakage but also whether the refrigerant leakage in the refrigerant circuit (20) has progressed to a predetermined level.

In the ninth aspect, since there appears a predetermined change in the amount of refrigerant exergy loss in the evaporator (34, 37) when there is refrigerant leakage in the refrigerant circuit (20), refrigerant leakage diagnosis is performed based on the evaporator-side index value which is calculated based on the amount of refrigerant exergy loss in the evaporator (34, 37). Therefore, it is possible to realize refrigerant leakage diagnosis using the amount of refrigerant exergy loss in the evaporator (34, 37).

In the tenth aspect, since there appears a predetermined change in the ratio of one of "the amount of exergy loss during the process in which the refrigerant is in a two-phase gas/liquid state in the evaporator (34, 37)" and "the amount of exergy loss during the process in which the refrigerant is in a single-phase gas state in the evaporator (34, 37)" with respect to the other when there is refrigerant leakage in the refrigerant circuit (20), the ratio is used as the evaporator-side index value and refrigerant leakage diagnosis is performed based on the evaporator-side index value. The evaporator-side index value is a ratio between amounts of exergy loss, and therefore is a normalized value. Therefore, as in the fourth aspect, it is possible to perform refrigerant leakage diagnosis without taking into consideration the rated capacity of the refrigerant circuit (20).

In the eleventh aspect, where the degree of opening of the expansion valve (36) is adjusted so that the degree of superheat of the refrigerant flowing out of the evaporator (34, 37) is constant, there appears a change in the degree of opening of the expansion valve (36) earlier than in the evaporator-side index value, and therefore it is determined that there is refrigerant leakage when the degree of opening of the expansion valve (36) is greater than or equal to a judgment degree of opening. Therefore, it is possible to detect refrigerant leakage at a stage where the amount of refrigerant which has leaked from the refrigerant circuit (20) is still small.

In the twelfth aspect, since there appears a predetermined change in the amount of refrigerant exergy loss in the compressor (30) when there is refrigerant leakage in the refrigerant circuit (20), refrigerant leakage diagnosis is performed based on the compressor-side index value which is calculated based on the amount of refrigerant exergy loss in the compressor (30). Therefore, it is possible to realize refrigerant leakage diagnosis using the amount of refrigerant exergy loss in the compressor (30).

In the thirteenth aspect, since there appears a predetermined change in the ratio of one of "the amount of refrigerant exergy loss in the radiator (34, 37)" and "the amount of refrigerant exergy loss in the evaporator (34, 37)" with respect to the other when there is refrigerant leakage in the refrigerant circuit (20), the ratio is used as the leakage index value and refrigerant leakage diagnosis is performed based on the leakage index value. The leakage index value is a ratio between amounts of exergy loss, and therefore is a normalized value. Therefore, as in the fourth aspect, it is possible to perform refrigerant leakage diagnosis without taking into consideration the rated capacity of the refrigerant circuit (20).

In the fourteenth aspect, it is not determined that there is refrigerant leakage when a relatively large amount of refrigerant is accumulated in the accumulator (38) even if it can be determined that there is refrigerant leakage based on the leakage index value. Here, for example, if the air-conditioning load decreases, the amount of refrigerant circulating in the refrigerant circuit (20) decreases, and the amount of refrigerant accumulated in the accumulator (38) increases. However, even if the operation capacity of the compressor (30) increases after the amount of refrigerant accumulated in the accumulator (38) increases, it takes time for the amount of refrigerant in the accumulator (38) to decrease. Therefore, the amount of refrigerant circulating in the refrigerant circuit (20) is insufficient until the amount of refrigerant in the accumulator (38) decreases, and such a state may possibly be determined erroneously as refrigerant leakage. In the fourteenth aspect, in order to prevent such erroneous determination, the process determines that a relatively large amount of refrigerant is accumulated in the accumulator (38) and does not determine that there is refrigerant leakage when the difference between the degree of superheat of the refrigerant flowing into the accumulator (38) and the degree of superheat of the refrigerant flowing out of the accumulator (38) is greater than or equal to a predetermined suction-side reference value even if it can be determined that there is refrigerant leakage based on the leakage index value. Thus, it is possible to suppress erroneous determination of a state where a relatively large amount of refrigerant is accumulated in the accumulator (38) as being refrigerant leakage.

DESCRIPTION OF EMBODIMENTS

An embodiment of the present invention will now be described in detail with reference to the drawings.

Figure 1:
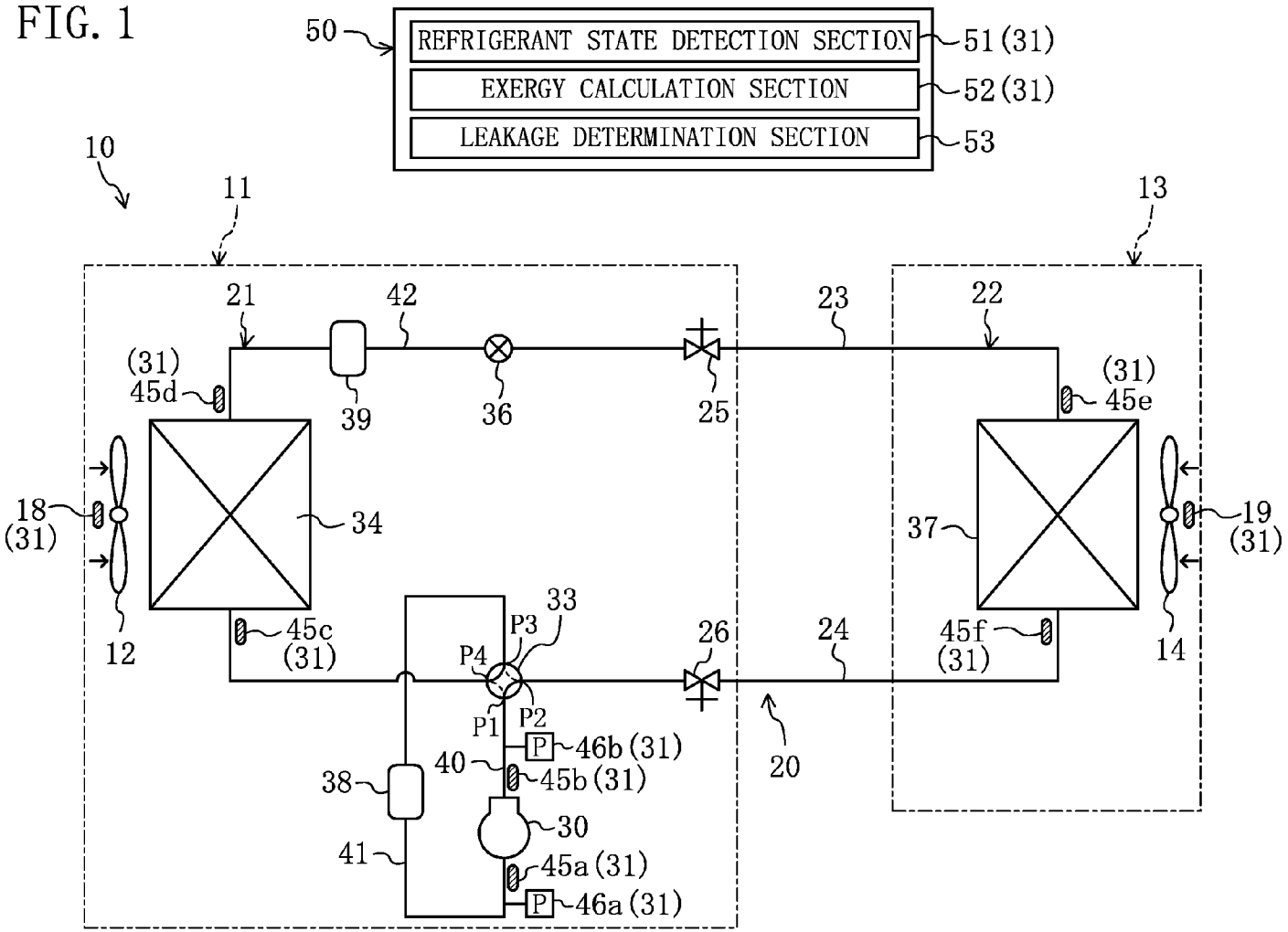
FIG. 1 A schematic configuration diagram of an air conditioner apparatus according to an embodiment.

The present embodiment is a refrigeration apparatus (10) including a leakage diagnosis apparatus (50) of the present invention. As shown in FIG. 1, the refrigeration apparatus (10) is an air conditioner apparatus (10) including an outdoor unit (11) and an indoor unit (13), and is configured so that it can be switched between a cooling operation and a heating operation.

—Configuration of Refrigeration Apparatus—

An outdoor circuit (21) is provided in the outdoor unit (11). An indoor circuit (22) is provided in the indoor unit (13). In the refrigeration apparatus (10), the outdoor circuit (21) and the indoor circuit (22) are connected together by a liquid-side communication pipe (23) and a gas-side communication pipe (24), thereby forming a refrigerant circuit (20) performing a vapor-compression refrigeration cycle. The refrigerant circuit (20) is charged with fluorocarbon refrigerant, for example. The amount of refrigerant charged in the refrigerant circuit (20) is determined based on the amount of refrigerant necessary for the heating operation.

<<Outdoor Unit>>

A compressor (30), an outdoor heat exchanger (34) forming a heat source-side heat exchanger, and an expansion valve (36) forming a depressurization mechanism are provided as circuit components in the outdoor circuit (21) of the outdoor unit (11). A four-way selector valve (33) to which the compressor (30) is connected, a liquid-side stop valve (25) to which the liquid-side communication pipe (23) is connected, and a gas-side stop valve (26) to which the gas-side communication pipe (24) is connected are provided in the outdoor circuit (21).

The compressor (30) is formed by a high pressure dome-type compressor in which the inside of a hermetic container-like casing is filled with compressed refrigerant. The discharge side of the compressor (30) is connected to a first port (P1) of the four-way selector valve (33) via a discharge pipe (40). The suction side of the compressor (30) is connected to a third port (P3) of the four-way selector valve (33) via a suction pipe (41). A hermetic container-like accumulator (38) is provided along the suction pipe (41).

The outdoor heat exchanger (34) is formed by a cross-fin fin-and-tube heat exchanger. The outdoor air is supplied to the outdoor heat exchanger (34) by an outdoor fan (12) provided in the vicinity of the outdoor heat exchanger (34). In the outdoor heat exchanger (34), heat is exchanged between the outdoor air and the refrigerant. Note that the airflow volume of the outdoor fan (12) can be adjusted through a plurality of steps.

One end of the outdoor heat exchanger (34) is connected to a fourth port (P4) of the four-way selector valve (33). The other end of the outdoor heat exchanger (34) is connected to the liquid-side stop valve (25) via a liquid pipe (42). The expansion valve (36) whose degree of opening is variable and a hermetic container-like receiver (39) are provided along the liquid pipe (42). A second port (P2) of the four-way selector valve (33) is connected to the gas-side stop valve (26).

The four-way selector valve (33) can be switched between a first state (a state indicated by a solid line in FIG. 1) in which the first port (P1) and the second port (P2) are communicated with each other and the third port (P3) and the fourth port (P4) are communicated with each other, and a second state (a state indicated by a broken line in FIG. 1) in which the first port (P1) and the fourth port (P4) are communicated with each other and the second port (P2) and the third port (P3) are communicated with each other.

In the outdoor circuit (21), a pair of a suction temperature sensor (45*a*) and a suction pressure sensor (46*a*) are provided on the suction side of the compressor (30). A pair of a discharge temperature sensor (45*b*) and a discharge pressure sensor (46*b*) are provided on the discharge side of the compressor (30). An outdoor gas temperature sensor (45*c*) is provided on the gas side of the outdoor heat exchanger (34). An outdoor liquid temperature sensor (45*d*) is provided on the liquid side of the outdoor heat exchanger (34). An outdoor temperature sensor (18) is provided upstream of the outdoor fan (12).

<<Indoor Unit>>

An indoor heat exchanger (37) forming a utilization-side heat exchanger is provided as a circuit component in the indoor circuit (22) of the indoor unit (13). The indoor heat exchanger (37) is formed by a cross-fin type fin-and-tube heat exchanger. The indoor air is supplied to the indoor heat exchanger (37) by an indoor fan (14) provided in the vicinity of the indoor heat exchanger (37). In the indoor heat exchanger (37), heat is exchanged between the indoor air and the refrigerant. Note that the airflow volume of the indoor fan (14) can be adjusted through a plurality of steps. In the indoor unit (13), an air filter is provided (not shown) between a suction port which is opened on the indoor side and the indoor fan (14).

In the indoor circuit (22), an indoor liquid temperature sensor (45*e*) is provided on the liquid side of the indoor heat exchanger (37). An indoor gas temperature sensor (45*f*) is provided on the gas side of the indoor heat exchanger (37). An indoor temperature sensor (19) is provided upstream of the indoor fan (14).

Note that the various sensors (18, 45, 46) of the outdoor unit (11) and the various sensors (19, 45, 46) of the indoor unit (13) described above may be regarded as part of index value calculation means (31) of the leakage diagnosis apparatus (50) to be described later, or as part of the refrigeration apparatus (10).

<<Configuration of Leakage Diagnosis Apparatus>>

The refrigeration apparatus (10) of the present embodiment includes the leakage diagnosis apparatus (50) of the present invention. The leakage diagnosis apparatus (50) is configured to perform a leakage detection operation for detecting whether there is refrigerant leakage in the refrigerant circuit (20). The leakage detection operation is an operation for detecting a decrease in refrigerant in the refrigerant circuit (20) from the reference state where there is no refrigerant leakage.

The leakage diagnosis apparatus (50) includes a refrigerant state detection section (51), an exergy calculation section (52), and a leakage determination section (53). In the present embodiment, the refrigerant state detection section (51) and the exergy calculation section (52) form the index value calculation means (31), and the leakage determination section (53) forms the leakage determination means (53).

Figure 2:
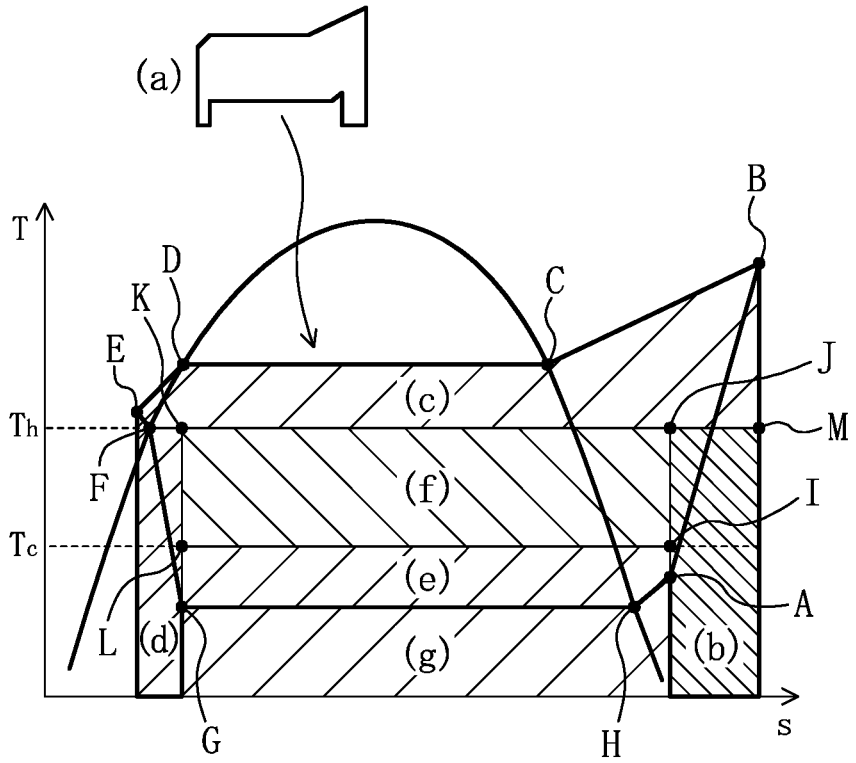
FIG. 2 A T-s graph (temperature-entropy graph) showing regions to be used for the calculation of the leakage index value in a leakage diagnosis apparatus according to the embodiment.

The refrigerant state detection section (51) is configured to detect the temperature and the entropy of the refrigerant at the inlet of the compressor (30) (the outlet of the evaporator (34, 37)) (the coordinate values at Point A in FIG. 2), the temperature and the entropy of the refrigerant at the outlet of the compressor (30) (the inlet of the condenser (34, 37)) (the coordinate values at Point B in FIG. 2), the temperature and the entropy of the refrigerant at the inlet of the expansion valve (36) (the outlet of the condenser (34, 37)) (the coordinate values at Point E in FIG. 2), and the temperature and the entropy of the refrigerant at the outlet of the expansion valve (36) (the inlet of the evaporator (34, 37)) (the coordinate values at Point G in FIG. 2). The temperature of refrigerant is directly detected from the measured value of a temperature sensor (45), and the entropy of the refrigerant is calculated from the measured value of the temperature sensor (45) and the measured value of a pressure sensor (46).

Using the temperature and the entropy of the refrigerant obtained by the refrigerant state detection section (51), the exergy calculation section (52) detects the amount of refrigerant exergy loss in each of various circuit components, i.e., the compressor (30), the condenser (34, 37) and the evaporator (34, 37), and calculates the leakage index value which varies depending on the amount of refrigerant which has leaked from the refrigerant circuit (20) by using the amounts of exergy loss. The exergy calculation section (52) calculates, as leakage index values, a radiator-side index value using the amount of refrigerant exergy loss in the condenser (34, 37), an evaporator-side index value using the amount of refrigerant exergy loss in the evaporator (34, 37), and a compressor-side index value using the amount of refrigerant exergy loss in the compressor (30).

Note that in the exergy calculation section (52), exergy analysis (thermodynamic analysis) is used for detecting the amount of refrigerant exergy loss in each circuit component. The amount of refrigerant exergy loss in a circuit component represents the magnitude of loss occurring in the circuit component (the value of loss in the circuit component).

Specifically, using the temperature and the entropy of the refrigerant obtained by the refrigerant state detection section (51), the exergy calculation section (52) detects the amount of refrigerant exergy loss $\Delta E(c)$ in the condenser (34, 37), the amount of refrigerant exergy loss $\Delta E(e)$ in the evaporator (34, 37), and the amount of refrigerant exergy loss $\Delta E(b)$ in the compressor (30). Using the temperature and the entropy of the refrigerant obtained by the refrigerant state detection section (51), the exergy calculation section (52) detects the input (the input power) $\Delta E(a)$ to the compressor (30), and the amount of heat dissipation $\Delta E(a+g)$ from the refrigerant in the condenser (34, 37). In the compressor (30), the refrigerant exergy is increased by the input $\Delta E(a)$ to the compressor (30), but the refrigerant exergy is lost through mechanical loss or heat dissipation loss.

Then, the exergy calculation section (52) calculates the ratio R1 ($R1=\Delta E(c)/\Delta E(a)$) of "the amount of refrigerant exergy loss $\Delta E(c)$ in the condenser (34, 37)" with respect to "the input $\Delta E(a)$ to the compressor (30)," and outputs the ratio R1, as the first radiator-side index value. The exergy calculation section (52) calculates the ratio R2 ($R2=\Delta E(c)/\Delta E(a+g)$) of "the amount of refrigerant exergy loss $\Delta E(c)$ in the condenser (34, 37)" with respect to "the amount of heat dissipation ΔE(a+g) from the refrigerant in the condenser (34, 37)," and outputs the ratio R2, as the second radiator-side index value.

Moreover, the exergy calculation section (52) outputs the amount of refrigerant exergy loss ΔE(e) in the evaporator (34, 37), as it is, as the evaporator-side index value. The exergy calculation section (52) outputs the amount of refrigerant exergy loss ΔE(b) in the compressor (30), as it is, as the compressor-side index value. Note that the amount of exergy loss ΔE(e) during the process in which the refrigerant is in a single-phase gas state in the evaporator (34, 37) can be used as the evaporator-side index value.

The leakage determination section (53) determines whether there is refrigerant leakage in the refrigerant circuit (20) based on the leakage index value calculated in the exergy calculation section (52). Specifically, the leakage determination section (53) determines whether there is refrigerant leakage in the refrigerant circuit (20) by using the leakage index value output from the exergy calculation section (52), and the value (reference value) in a reference state where there is no refrigerant leakage in the refrigerant circuit (20). The leakage determination section (53) determines whether there is refrigerant leakage based on the radiator-side index value, and determines whether the refrigerant leakage has progressed to a predetermined level (such a level that circuit components may possibly be damaged due to refrigerant shortage) based on the evaporator-side index value.

The leakage determination section (53) includes a memory for storing reference values of the leakage index values. The memory stores the reference-state value of the ratio of "the amount of refrigerant exergy loss in the condenser (34, 37)" with respect to "the input to the compressor (30)" as the first reference value R1 (0), the reference-state value of the ratio of "the amount of refrigerant exergy loss in the condenser (34, 37)" with respect to "the amount of heat dissipation from the refrigerant in the condenser (34, 37)" as the second reference value R2 (0), the reference-state value of the amount of refrigerant exergy loss in the evaporator (34, 37) as the third reference value, and the reference-state value of the amount of refrigerant exergy loss in the compressor (30) as the fourth reference value. These reference values are values obtained in advance as values in a reference state during a cooling operation.

The leakage determination section (53) determines whether there is refrigerant leakage based on a change where the amount of refrigerant exergy loss ΔE(c) in the condenser (34, 37) decreases from the reference state. Specifically, the leakage determination section (53) determines whether there is refrigerant leakage based on the rate of change of the first radiator-side index value from the reference state and the rate of change of the second radiator-side index value from the reference state. Note that only one of the rate of change of the first radiator-side index value from the reference state and the rate of change of the second radiator-side index value from the reference state may be used for this determination.

The leakage determination section (53) determines whether the refrigerant leakage has progressed to a predetermined level based both on a change where the amount of refrigerant exergy loss ΔE(e) in the evaporator (34, 37) increases from the reference state, and on a change where the amount of refrigerant exergy loss ΔE(b) in the compressor (30) increases from the reference state. Specifically, the leakage determination section (53) determines whether the refrigerant leakage has progressed to a predetermined level based on the rate of change of the evaporator-side index value from the reference state, and the rate of change of the compressor-side index value from the reference state.

—Operation of Refrigeration Apparatus—

An operation of the refrigeration apparatus (10) will be described. The refrigeration apparatus (10) is configured so that it can be switched between a cooling operation and a heating operation by the four-way selector valve (33).

<Cooling Operation>

In the cooling operation, the four-way selector valve (33) is set to the second state. When the compressor (30) is operated in this state, a vapor-compression refrigeration cycle is performed in the refrigerant circuit (20) in which the outdoor heat exchanger (34) serves as a condenser and the indoor heat exchanger (37) serves as an evaporator.

Note that in the cooling operation, the operation frequency of the compressor (30) is controlled so that the low-pressure value of the refrigeration cycle (the detection value of the suction pressure sensor (46*a*)) is constant, and the degree of opening of the expansion valve (36) is adjusted so that the degree of superheat of the refrigerant at the outlet of the indoor heat exchanger (37) is equal to a predetermined target value (e.g., 5° C.).

Specifically, the refrigerant which has been compressed in the compressor (30) condenses by exchanging heat with the outdoor air in the outdoor heat exchanger (34). The refrigerant which has condensed in the outdoor heat exchanger (34) is depressurized while passing through the expansion valve (36), and then evaporates by exchanging heat with the indoor air in the indoor heat exchanger (37). The refrigerant which has evaporated in the indoor heat exchanger (37) is compressed again in the compressor (30).

<Heating Operation>

In the heating operation, the four-way selector valve (33) is set to the first state. When the compressor (30) is operated in this state, a vapor-compression refrigeration cycle is performed in the refrigerant circuit (20) in which the outdoor heat exchanger (34) serves as an evaporator and the indoor heat exchanger (37) serves as a condenser.

Note that in the heating operation, the operation frequency of the compressor (30) is controlled so that the high-pressure value of the refrigeration cycle (the detection value of the discharge pressure sensor (46*b*)) is constant, and the degree of opening of the expansion valve (36) is adjusted so that the degree of subcooling of the refrigerant at the outlet of the indoor heat exchanger (37) is equal to a predetermined target value (e.g., 5° C.).

Specifically, the refrigerant which has been compressed in the compressor (30) condenses by exchanging heat with the indoor air in the indoor heat exchanger (37). The refrigerant which has condensed in the indoor heat exchanger (37) is depressurized while passing through the expansion valve (36), and then evaporates by exchanging heat with the outdoor air in the outdoor heat exchanger (34). The refrigerant which has evaporated in the outdoor heat exchanger (34) is compressed again in the compressor (30).

—Operation of Leakage Diagnosis Apparatus—

The operation of the leakage diagnosis apparatus (50) will be described. The leakage diagnosis apparatus (50) performs a leakage detection operation during the cooling operation and during the heating operation. The leakage diagnosis apparatus (50) performs the leakage detection operation at a predetermined control frequency, for example. The leakage detection operation during the cooling operation will be described below.

In the leakage detection operation, the process first performs a first step of detecting the temperature and the entropy of the refrigerant at predetermined positions in the refrigerant circuit (20). The predetermined positions in the refrigerant circuit (20) are the inlet and the outlet of the compressor (30), and the inlet and the outlet of the expansion valve (36).

In the first step, the refrigerant state detection section (51) detects the measured value of the suction temperature sensor (45*a*) as the temperature of the refrigerant at the inlet of the compressor (30). The refrigerant state detection section (51) calculates the entropy of the refrigerant at the inlet of the compressor (30) by using the measured value of the suction temperature sensor (45*a*) and the measured value of the suction pressure sensor (46*a*). Thus, the coordinate values of Point A in the T-s graph shown in FIG. 2 are obtained.

The refrigerant state detection section (51) detects the measured value of the discharge temperature sensor (45*b*) as the temperature of the refrigerant at the outlet of the compressor (30). The refrigerant state detection section (51) calculates the entropy of the refrigerant at the outlet of the compressor (30) by using the measured value of the discharge temperature sensor (45*b*) and the measured value of the discharge pressure sensor (46*b*). Thus, the coordinate values of Point B in the T-s graph shown in FIG. 2 are obtained.

The refrigerant state detection section (51) detects the measured value of the outdoor liquid temperature sensor (45*d*) as the temperature of the refrigerant at the inlet of the expansion valve (36). The refrigerant state detection section (51) calculates the entropy of the refrigerant at the inlet of the expansion valve (36) by using the measured value of the outdoor liquid temperature sensor (45*d*) and the measured value of the discharge pressure sensor (46*b*). In the calculation of the entropy of the refrigerant at the inlet of the expansion valve (36), the measured value of the discharge pressure sensor (46*b*) is used, regarding the pressure at the inlet of the expansion valve (36) as being equal to the pressure at the outlet of the compressor (30). Thus, the coordinate values of Point E in the T-s graph shown in FIG. 2 are obtained.

The refrigerant state detection section (51) detects the measured value of the indoor liquid temperature sensor (45*e*) as the temperature of the refrigerant at the outlet of the expansion valve (36). The refrigerant state detection section (51) calculates the entropy of the refrigerant at the outlet of the expansion valve (36) by using the measured value of the indoor liquid temperature sensor (45*e*) and the measured value of the suction pressure sensor (46*a*). In the calculation of the entropy of the refrigerant at the outlet of the expansion valve (36), the measured value of the suction pressure sensor (46*a*) is used, regarding the pressure at the outlet of the expansion valve (36) as being equal to the pressure at the inlet of the compressor (30). Since the refrigerant at the outlet of the expansion valve (36) is in a two-phase gas/liquid state during the cooling operation, it is assumed that the enthalpy of the refrigerant at the inlet of the expansion valve (36) is equal to the enthalpy of the refrigerant at the outlet of the expansion valve (36) so that the entropy can be calculated from the temperature and the pressure of the refrigerant. Thus, the coordinate values of Point G in the T-s graph shown in FIG. 2 are obtained.

Then, the process performs a second step of calculating the leakage index value. The second step, together with the first step, forms the index value calculation step.

In the second step, the exergy calculation section (52) calculates the amount of refrigerant exergy loss ΔE(c) in the outdoor heat exchanger (34) operating as a condenser, the amount of refrigerant exergy loss ΔE(e) in the indoor heat exchanger (37) operating as an evaporator, the amount of refrigerant exergy loss ΔE(b) in the compressor (30), the input ΔE(a) to the compressor (30), and the amount of heat dissipation ΔE(a+g) from the refrigerant in the outdoor heat exchanger (34).

Here, in the T-s graph shown in FIG. 2, the amounts of refrigerant exergy loss in circuit components (the compressor (30), the condenser (34, 37), the expansion valve (36), the evaporator (34, 37)) can be obtained using the areas of the regions delimited by using a line representing the refrigeration cycle.

In FIG. 2, Th represents the temperature of the air sent into the condenser (34, 37) (the measured value of the outdoor temperature sensor (18) in the cooling operation), and Tc represents the temperature of the air sent into the evaporator (34, 37) (the measured value of the indoor temperature sensor (19) in the cooling operation).

Point A is a point defined by the temperature and the entropy of the refrigerant at the inlet of the compressor (30) (the outlet of the evaporator (34, 37)). Point B is a point defined by the temperature and the entropy of the refrigerant at the outlet of the compressor (30) (the inlet of the condenser (34, 37)). Point E is a point defined by the temperature and the entropy of the refrigerant at the inlet of the expansion valve (36) (the outlet of the condenser (34, 37)). Point G is a point defined by the temperature and the entropy of the refrigerant at the outlet of the expansion valve (36) (the inlet of the evaporator (34, 37)).

Point C is the intersection between an equi-pressure line that passes through Point B and the saturated vapor line. Point D is the intersection between an isothermal line that passes through Point C and the saturated liquid line. Point F is the intersection between an isenthalpic line that passes through Point E and the saturated liquid line. Point H is the intersection between an isothermal line that passes through Point G and the saturated vapor line. Point I is a point along an isentropic line that passes through Point A at which the temperature is Tc. Point J is a point along an isentropic line that passes through Point A at which the temperature is Th. Point K is a point along an isentropic line that passes through Point G at which the temperature is Th. Point L is a point along an isentropic line that passes through Point G at which the temperature is Th. Point M is a point along an isentropic line that passes through Point B at which the temperature is Th.

Note that in the present embodiment, coordinate values of Point C, Point D, Point F, Point H, Point I, Point J, Point K, Point L and Point M are calculated using the coordinate values of Point A, Point B, Point E and Point G, the measured value of the outdoor temperature sensor (18), and the measured value of the indoor temperature sensor (19).

In FIG. 2, the input ΔE(a) to the compressor (30) is represented by the area of the region (a). The amount of refrigerant exergy loss ΔE(b) in the compressor (30) is represented by the area of the region (b). The amount of refrigerant exergy loss ΔE(c) in the condenser (34, 37) is represented by the area of the region (c). The amount of refrigerant exergy loss ΔE(d) in the expansion valve (36) is represented by the area of the region (d). The amount of refrigerant exergy loss ΔE(e) in the evaporator (34, 37) is represented by the area of the region (e). Note that the region (a) is a region obtained by subtracting the region (g) from the entire hatched region.

In FIG. 2, the workload ΔE(f) of the reverse Carnot cycle is represented by the area of the region (f). The amount of heat dissipation ΔE(a+g) from the refrigerant in the condenser (34, 37) is represented by the area of a region lying under a line that extends from Point B to Point E via Point C and Point D, i.e., the area of the region obtained by adding the region (g) to the region (a) (the entire hatched area in FIG. 2). The amount of heat absorption ΔE(g) of the refrigerant in the evaporator (34, 37) is represented by the area of a region lying under a line that extends from Point G to Point A via Point H, i.e., the area of the region (g).

The exergy calculation section (52) calculates the amount of refrigerant exergy loss ΔE(c) in the outdoor heat exchanger (34) using the coordinate values of Point B, Point C, Point D and Point E and the measured value Th of the outdoor temperature sensor (18). The exergy calculation section (52) calculates the amount of refrigerant exergy loss ΔE(e) in the indoor heat exchanger (37) using the coordinate values of Point A, Point G and Point H and the measured value Tc of the indoor temperature sensor (19). The exergy calculation section (52) calculates the amount of refrigerant exergy loss ΔE(b) in the compressor (30) using the coordinate values of Point A and Point B and the measured value Th of the outdoor temperature sensor (18). The exergy calculation section (52) calculates the input ΔE(a) to the compressor (30) using the coordinate values of Point A, Point B, Point C, Point D, Point E, Point G and Point H. The exergy calculation section (52) calculates the amount of heat dissipation ΔE(a+g) from the refrigerant in the outdoor heat exchanger (34) using the coordinate values of Point B, Point C, Point D and Point E.

Note that the exergy calculation section (52) may be configured to calculate, as the amount of refrigerant exergy loss ΔE(b) in the compressor (30), the area of a region lying under a line that connects together Point A and Point B. In such a case, the amount of refrigerant exergy loss ΔE(b) in the compressor (30) is a value obtained by integrating changes in the temperature of the refrigerant from the inlet to the outlet of the compressor (30) over an interval from the entropy of the refrigerant at the inlet of the compressor (30) to the entropy of the refrigerant at the outlet of the compressor (30).

Then, the exergy calculation section (52) calculates the ratio R1 (R1=ΔE(c)/ΔE(a)) of "the amount of refrigerant exergy loss ΔE(c) in the outdoor heat exchanger (34)" with respect to "the input ΔE(a) to the compressor (30)" and outputs the ratio R1 as the first radiator-side index value. The exergy calculation section (52) calculates the ratio R2 (R2=ΔE(c)/ΔE(a+g)) of "the amount of refrigerant exergy loss ΔE(c) in the outdoor heat exchanger (34)" with respect to "the amount of heat dissipation ΔE(a+g) from the refrigerant in the outdoor heat exchanger (34)" and outputs the ratio R2 as the second radiator-side index value. The exergy calculation section (52) outputs the amount of refrigerant exergy loss ΔE(e) in the evaporator (34, 37) as the evaporator-side index value, and outputs the amount of refrigerant exergy loss ΔE(b) in the compressor (30) as the compressor-side index value. Thus, the second step ends.

Then, the process performs a third step of determining whether there is refrigerant leakage in the refrigerant circuit (20). The third step forms the leakage determination step.

In the third step, first, the leakage determination section (53) reads out the first reference value R1(0) and the second reference value R2(0) from the memory. Then, the leakage determination section (53) calculates the rate of change (R1/R1(0)) of the first radiator-side index value from the reference state by dividing first radiator-side index value R1 by the first reference value R1(0). The leakage determination section (53) determines whether a first judgment condition holds such that the rate of change of the first radiator-side index value from the reference state is less than or equal to a predetermined first decrease judgment value.

The leakage determination section (53) calculates the rate of change (R2/R2(0)) of the second radiator-side index value from the reference state by dividing the second radiator-side index value R2 by the second reference value R2(0). The leakage determination section (53) determines whether a second judgment condition holds such that the rate of change of the second radiator-side index value from the reference state is less than or equal to a predetermined second decrease judgment value.

The leakage determination section (53) determines that there is refrigerant leakage in the refrigerant circuit (20) if at least one of the first judgment condition and the second judgment condition holds. On the other hand, the leakage determination section (53) determines that there is no refrigerant leakage in the refrigerant circuit (20) if neither the first judgment condition nor the second judgment condition holds.

Figure 3:
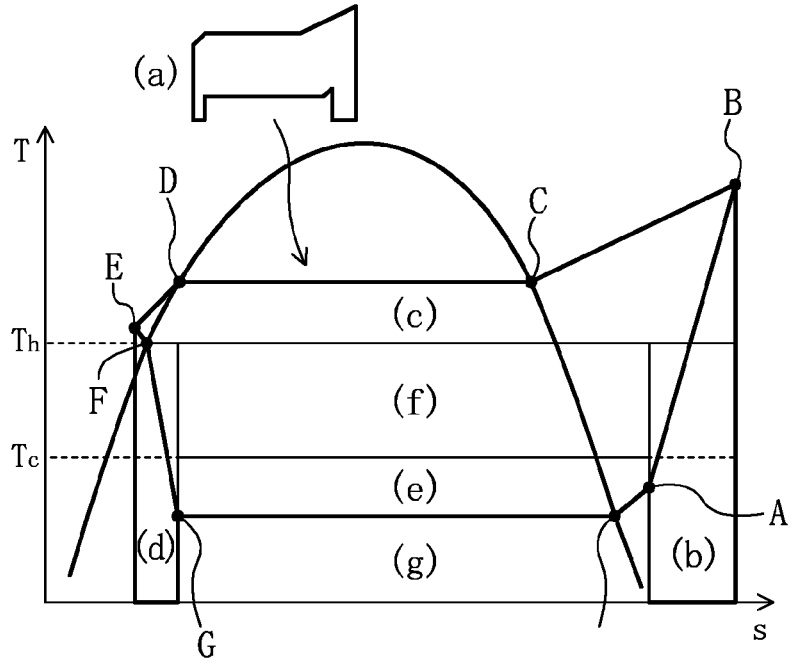
FIG. 3 A T-s graph showing regions to be used for the calculation of the leakage index value in a leakage diagnosis apparatus according to the embodiment, wherein (A) shows the reference state and (B) shows the first progressive state.
Figure 3:
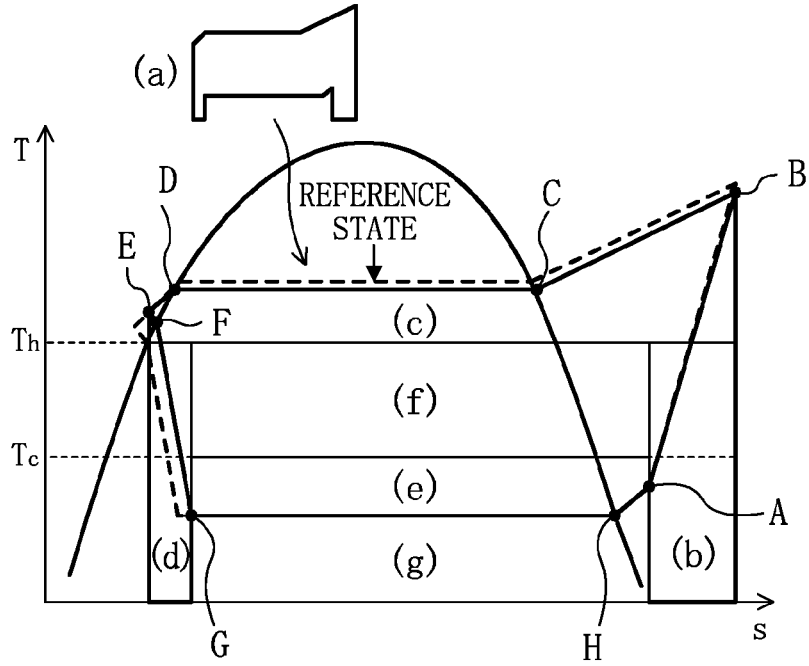

Here, in the first progressive state where the amount of refrigerant which has leaked from the refrigerant circuit (20) is relatively small, the condensation temperature of the refrigerant in the condenser (34) is lower than that in the reference state, as shown in FIG. 3. Since the temperature difference between the condensation temperature of the refrigerant in the condenser (34) and the outdoor air is small, the temperature of the refrigerant at the outlet of the condenser (34) is higher than that in the reference state, and the degree of subcooling of the refrigerant at the outlet of the condenser (34) is smaller than that in the reference state. The entropy of the refrigerant at the inlet of the expansion valve (36) and that at the outlet thereof are respectively higher than those in the reference state. While the high pressure in the refrigeration cycle is lower than that in the reference state, the low pressure in the refrigeration cycle is not substantially different from that in the reference state. The degree of superheat of the refrigerant at the outlet of the evaporator (37) is not substantially different from that in the reference state. As a result, the change in the amount of refrigerant exergy loss ΔE(c) in the condenser (34) from the reference state is particularly significant as compared with the amounts of refrigerant exergy loss of the other circuit components.

While the amount of refrigerant exergy loss ΔE(c) in the condenser (34) changes also when the condenser (34) deteriorates, the amount of refrigerant exergy loss ΔE(c) in the condenser (34) increases in such a case. Therefore, in the present embodiment, it is determined whether there is refrigerant leakage based on such a change that the amount of refrigerant exergy loss ΔE(c) in the condenser (34) decreases from the reference state.

In the first progressive state, the amount of refrigerant exergy loss ΔE(c) in the condenser (34) decreases from the reference state because the degree of subcooling of the refrigerant at the outlet of the condenser (34) decreases, thereby increasing the proportion of the gas/liquid region where the heat exchange efficiency is good for the effective channel length of the condenser (34), thus increasing the overall heat exchange efficiency. Note that in the first progressive state, the amount of refrigerant exergy loss ΔE(e) in the evaporator (37) slightly decreases from the reference state, and the amount of refrigerant exergy loss ΔE(b) in the compressor (30) and the amount of refrigerant exergy loss ΔE(d) in the expansion valve (36) do not substantially change from the reference state.

Note that the amount of refrigerant exergy loss in the condenser (34, 37) may be used, as it is, as the radiator-side index value. The method for determining whether there is refrigerant leakage based on the radiator-side index value is not limited to the method described above. For example, it may be determined that there is refrigerant leakage if such a condition holds that the radiator-side index value is below a predetermined judgment threshold. It may be determined that there is refrigerant leakage if such a condition holds that the average value of the radiator-side index value over a predetermined period (e.g., a month) is below a predetermined judgment threshold.

Then, the leakage determination section (53) reads out the third reference value and the fourth reference value from the memory. Then, the leakage determination section (53) calculates the rate of change of the evaporator-side index value from the reference state by dividing the evaporator-side index value ΔE(e) by the third reference value. The leakage determination section (53) determines whether such a third judgment condition holds that the rate of change of the evaporator-side index value from the reference state is greater than or equal to a predetermined first increase judgment value.

The leakage determination section (53) calculates the rate of change of the compressor-side index value from the reference state by dividing the compressor-side index value ΔE(b) by the fourth reference value. The leakage determination section (53) determines whether such a fourth judgment condition holds that the rate of change of the compressor-side index value from the reference state is greater than or equal to a predetermined second increase judgment value.

Note that the judgment values above (the first decrease judgment value, the second decrease judgment value, the first increase judgment value and the second increase judgment value) are all stored in the memory.

The leakage determination section (53) determines that the refrigerant leakage has progressed to a predetermined level (such a level that circuit components may possibly be damaged due to refrigerant shortage) if the third judgment condition and the fourth judgment condition both hold in a state where it has been determined that there is refrigerant leakage based on the radiator-side index value. In the present embodiment, the process does not determine that the refrigerant leakage has progressed to a predetermined level when only one of the third judgment condition and the fourth judgment condition holds. Note however that the leakage determination section (53) may be configured so that it determines that the refrigerant leakage has progressed to a predetermined level when at least one of the third judgment condition and the fourth judgment condition holds.

Figure 4:
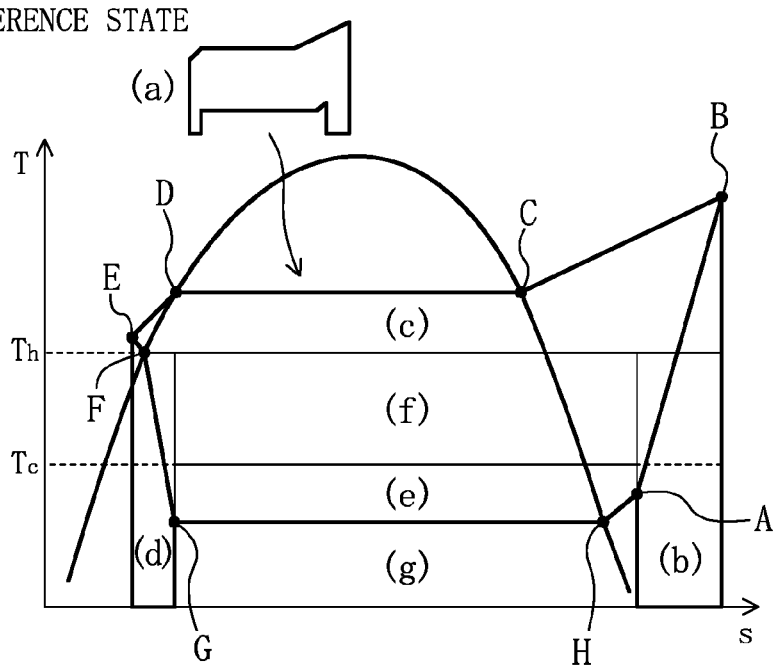
FIG. 4 A T-s graph showing regions to be used for the calculation of the leakage index value in a leakage diagnosis apparatus according to the embodiment, wherein (A) shows the reference state and (B) shows the second progressive state.
Figure 4:
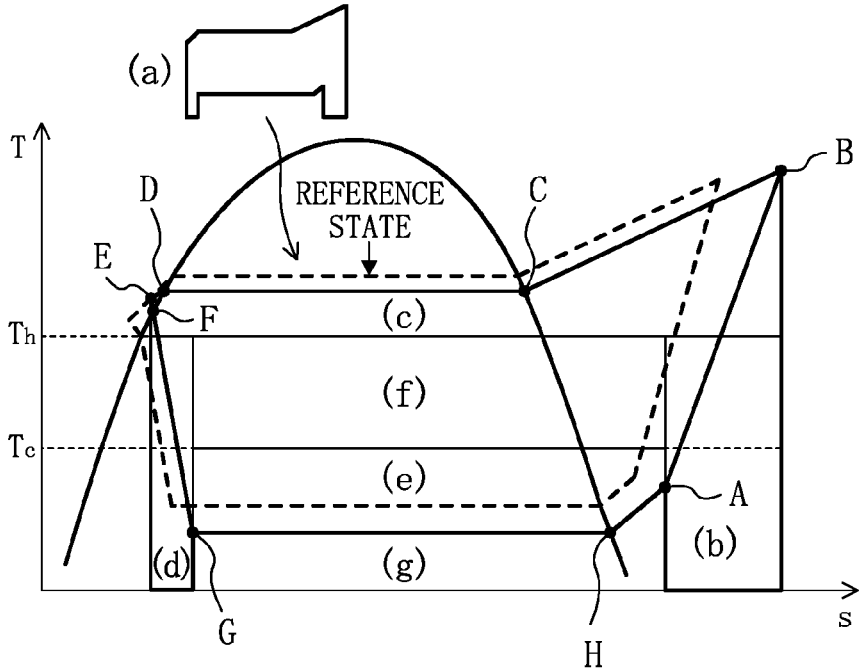

Here, as shown in FIG. 4, in the second progressive state where the amount of refrigerant which has leaked from the refrigerant circuit (20) is relatively large, the condensation temperature of the refrigerant in the condenser (34) is even lower than that in the first progressive state. The temperature of the refrigerant at the outlet of the condenser (34) is even higher than that in the first progressive state, and the degree of subcooling of the refrigerant at the outlet of the condenser (34) is even smaller than that in the first progressive state. The entropy of the refrigerant at the inlet of the expansion valve (36) and that at the outlet thereof are respectively even higher than those in the first progressive state. The high pressure in the refrigeration cycle is even lower than that in the first progressive state, and the low pressure in the refrigeration cycle is even lower than that in the first progressive state. The degree of superheat of the refrigerant at the outlet of the evaporator (37) is larger than that in the first progressive state. The amount of refrigerant exergy loss ΔE(c) in the condenser (34) is larger than that in the first progressive state. As a result, the change in the amount of refrigerant exergy loss ΔE(e) in the evaporator (37) from the reference state and the change in the amount of refrigerant exergy loss ΔE(b) in the compressor (30) from the reference state are particularly significant as compared with the amounts of refrigerant exergy loss of the other circuit components.

The amount of refrigerant exergy loss ΔE(e) in the evaporator (37) does not substantially change when the evaporator (37) deteriorates. Particularly, where the refrigerant circuit (20) is controlled so that the low pressure of the refrigeration cycle is constant, the amount of refrigerant exergy loss ΔE(e) in the evaporator (37) does not substantially change. Since the refrigerant circuit (20) is controlled so that the degree of superheat of the refrigerant flowing out of the evaporator (37) is constant even when the compressor (30) deteriorates, the amount of refrigerant exergy loss ΔE(b) in the compressor (30) does not substantially change. Therefore, in the present embodiment, it is determined whether the refrigerant leakage has progressed to a predetermined level based on a change where the amount of refrigerant exergy loss ΔE(e) in the evaporator (37) increases from the reference state and a change where the amount of refrigerant exergy loss ΔE(b) in the compressor (30) increases from the reference state.

Note that the method for determining whether there is refrigerant leakage based on leakage index values, i.e., the evaporator-side index value and the compressor-side index value, is not limited to the method described above. For example, it may be determined that the refrigerant leakage has progressed to a predetermined level when such a condition holds that the leakage index value exceeds a predetermined judgment threshold. It may be determined that the refrigerant leakage has progressed to a predetermined level when such a condition holds that the average value of the leakage index value over a predetermined period (e.g., a month) exceeds a predetermined judgment threshold.

Advantage of Embodiment

In the present embodiment, a leakage index value is calculated that undergoes a predetermined change when there is refrigerant leakage in the refrigerant circuit (20) based on the amount of refrigerant exergy loss in a circuit component, and refrigerant leakage diagnosis is performed based on the leakage index value. The refrigerant leakage in the refrigerant circuit (20) can be detected by, for example, monitoring the change in the leakage index value. Therefore, it is possible to realize refrigerant leakage diagnosis by using the amount of refrigerant exergy loss in a circuit component of the refrigerant circuit (20).

In the present embodiment, when there is refrigerant leakage in the refrigerant circuit (20), there appears a predetermined change in the amount of refrigerant exergy loss in the condenser (34, 37), and therefore refrigerant leakage diagnosis is performed based on the radiator-side index value which is calculated based on the amount of refrigerant exergy loss in the condenser (34, 37). Therefore, it is possible to realize refrigerant leakage diagnosis using the amount of refrigerant exergy loss in the condenser (34, 37). During the refrigeration operation in which the refrigerant circuit (20) is controlled so that the low pressure of the refrigeration cycle is constant, a somewhat significant change appears in the amount of refrigerant exergy loss in the condenser (34, 37) even in a state where the amount of refrigerant which has leaked from the refrigerant circuit (20) is relatively small. Therefore, it is possible to detect refrigerant leakage at a stage where the amount of refrigerant which has leaked from the refrigerant circuit (20) is still small. Then, it is possible to reduce the amount of refrigerant which leaks from the refrigerant circuit (20), and in a case where refrigerant that has an impact on the global environment is used, it is possible to reduce the impact on the global environment.

In the present embodiment, when there is refrigerant leakage in the refrigerant circuit (20), there appears a predetermined change in the amount of refrigerant exergy loss in the evaporator (34, 37), and therefore refrigerant leakage diagnosis is performed based on the evaporator-side index value which is calculated based on the amount of refrigerant exergy loss in the evaporator (34, 37). Therefore, it is possible to realize refrigerant leakage diagnosis using the amount of refrigerant exergy loss in the evaporator (34, 37).

In the present embodiment, when there is refrigerant leakage in the refrigerant circuit (20), there appears a predetermined change in the amount of refrigerant exergy loss in the compressor (30), and therefore refrigerant leakage diagnosis is performed based on the compressor-side index value which is calculated based on the amount of refrigerant exergy loss in the compressor (30). Therefore, it is possible to realize refrigerant leakage diagnosis using the amount of refrigerant exergy loss in the compressor (30).

In the present embodiment, it is determined whether the refrigerant leakage has progressed to a predetermined level based both on a change in the amount of refrigerant exergy loss in the evaporator (34, 37) from the reference state and on a change in the amount of refrigerant exergy loss in the compressor (30) from the reference state. Therefore, it is possible to more accurately determine whether the refrigerant leakage has progressed to a predetermined level.

In the present embodiment, it is determined whether there is refrigerant leakage in the refrigerant circuit (20) based on the radiator-side index value, and it is determined whether the refrigerant leakage in the refrigerant circuit (20) has progressed to a predetermined level based on the evaporator-side index value and the compressor-side index value. Therefore, it is possible to detect not only whether there is refrigerant leakage but also whether the refrigerant leakage has progressed to a predetermined level.

In the present embodiment, when there is refrigerant leakage in the refrigerant circuit (20), there appears a predetermined change in the ratio of "the amount of refrigerant exergy loss in the condenser (34, 37)" with respect to "the input to the compressor (30)," and therefore this ratio is used as the radiator-side index value and refrigerant leakage diagnosis is performed based on the radiator-side index value. When there is refrigerant leakage in the refrigerant circuit (20), there appears a predetermined change in the ratio of "the amount of refrigerant exergy loss in the condenser (34, 37)" with respect to "the amount of heat dissipation from the refrigerant in the condenser (34, 37)," and therefore this ratio is used as the radiator-side index value and refrigerant leakage diagnosis is performed based on the radiator-side index value. These radiator-side index values are ratios between amounts of exergy loss, and therefore are normalized values. Therefore, it is possible to perform refrigerant leakage diagnosis without taking into consideration the rated capacity of the refrigerant circuit (20).

In the present embodiment, "the input to the compressor (30)" is a value that reflects the operation state of the refrigerant circuit (20) (e.g., the amount of refrigerant circulating or the temperature of the outdoor air). "The amount of heat dissipation from the refrigerant in the condenser (34, 37)" is a value that reflects the operation state of the refrigerant circuit (20). The radiator-side index value which reflects the operation state of the refrigerant circuit (20) is used in the refrigerant leakage diagnosis. Therefore, it is possible to perform refrigerant leakage diagnosis without so much taking into consideration the operation state of the refrigerant circuit (20).

In the present embodiment, the leakage diagnosis apparatus (50) is provided which uses the amount of refrigerant exergy loss in a circuit component in order to determine whether there is refrigerant leakage in the refrigerant circuit (20). Therefore, it is possible to provide the refrigeration apparatus (10) capable of performing refrigerant leakage diagnosis using the amount of refrigerant exergy loss in a circuit component of the refrigerant circuit (20).

Variation 1 of Embodiment

Figure 5:
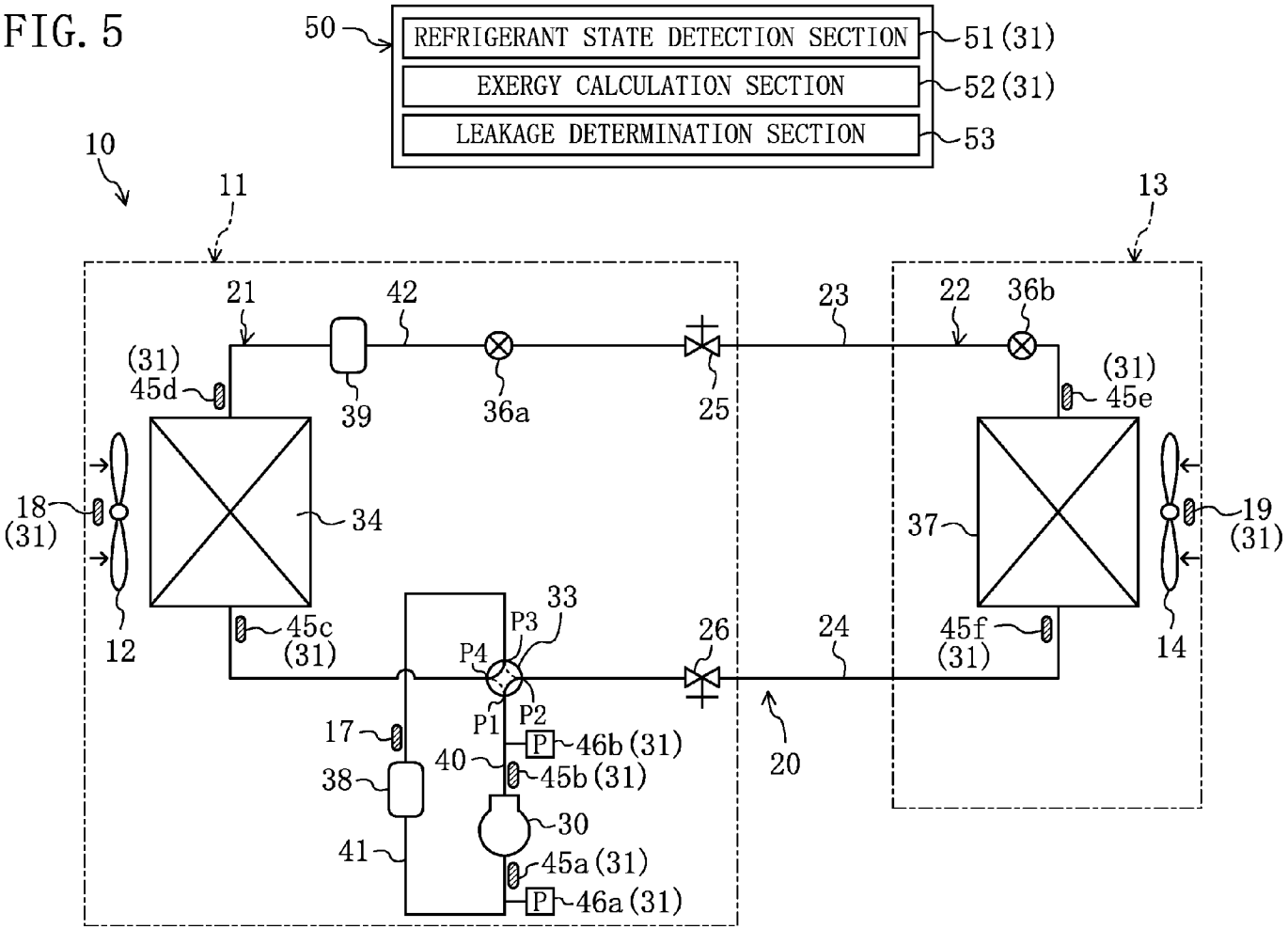
FIG. 5 A schematic configuration diagram of an air conditioner apparatus according to Variation 1 of the embodiment.

Variation 1 of the embodiment will be described. The leakage diagnosis apparatus (50) of Variation 1 differs from that of the embodiment in terms of the leakage detection operation. Note that Variation 1 is directed to the air conditioner apparatus (10) having a plurality of indoor units (13) connected in parallel to one another. Note however that FIG. 5, which is a schematic configuration diagram of the air conditioner apparatus (10) of Variation 1, shows only one indoor unit (13), omitting the other indoor units (13). As shown in FIG. 5, the air conditioner apparatus (10) with a plurality of indoor units (13) includes an outdoor expansion valve (36*a*) provided in the outdoor circuit (21) and an indoor expansion valve (36*b*) provided in the indoor circuit (22). Note that the leakage detection operation of Variation 1 is applicable also to the air conditioner apparatus (10) including a single indoor unit (13) as shown in FIG. 1.

The indoor expansion valve (36*b*) and the outdoor expansion valve (36*a*) are each formed by an electric expansion valve whose degree of opening is variable. An electric expansion valve of which the maximum value of the control pulse is 2000 pulses is used as the indoor expansion valve (36*b*). On the other hand, an electric expansion valve of which the maximum value of the control pulse is 480 pulses is used as the outdoor expansion valve (36*a*).

During the cooling operation, the outdoor expansion valve (36*a*) is fully opened, and the degree of opening of the indoor expansion valve (36*b*) is adjusted so that the degree of superheat of the refrigerant flowing out of the indoor heat exchanger (37) is constant (e.g., 5° C.). On the other hand, during the heating operation, the degree of opening of the outdoor expansion valve (36*a*) is adjusted so that the degree of superheat of the refrigerant flowing out of the outdoor heat exchanger (34) is constant (e.g., 5° C.), and the degree of opening of the indoor expansion valve (36*b*) is adjusted so that the degree of subcooling of the refrigerant flowing out of the indoor heat exchanger (37) is constant (e.g., 5° C.).

Figure 6:
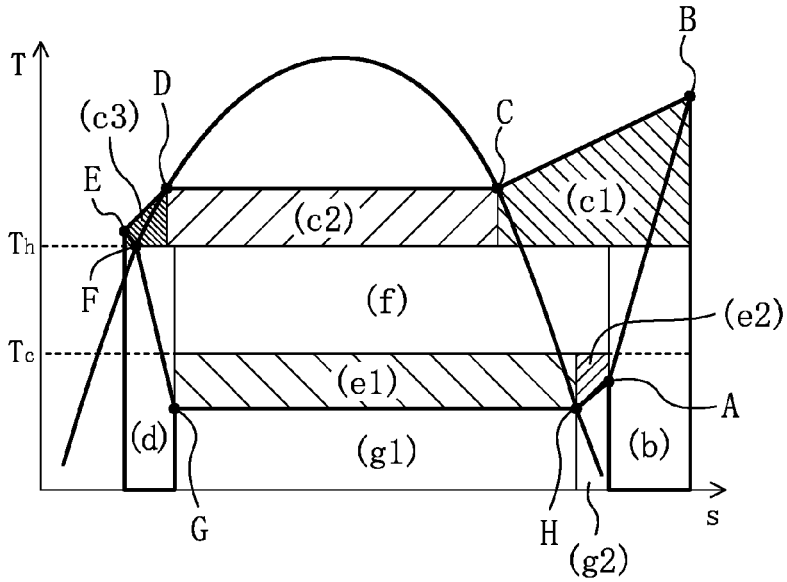
FIG. 6 A T-s graph showing regions to be used for the calculation of the leakage index value in a leakage diagnosis apparatus according to Variation 1 of the embodiment, wherein (A) shows the reference state and (B) shows the first progressive state.
Figure 6:
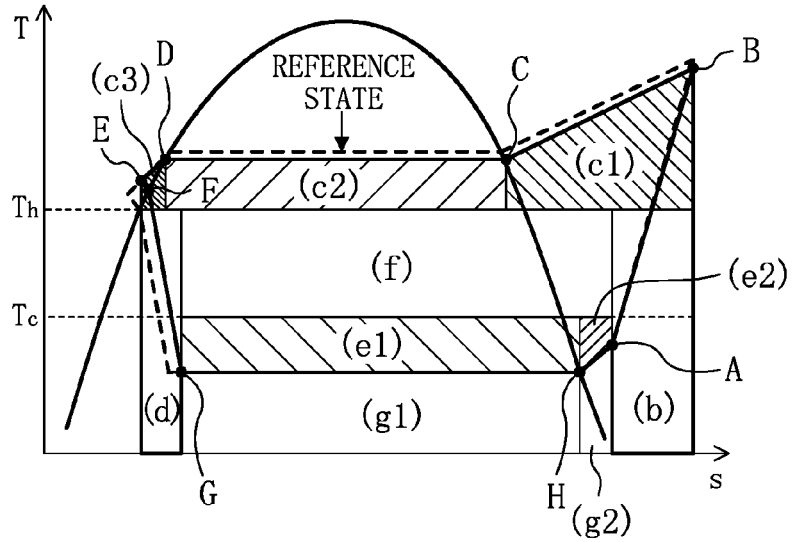
Figure 7:
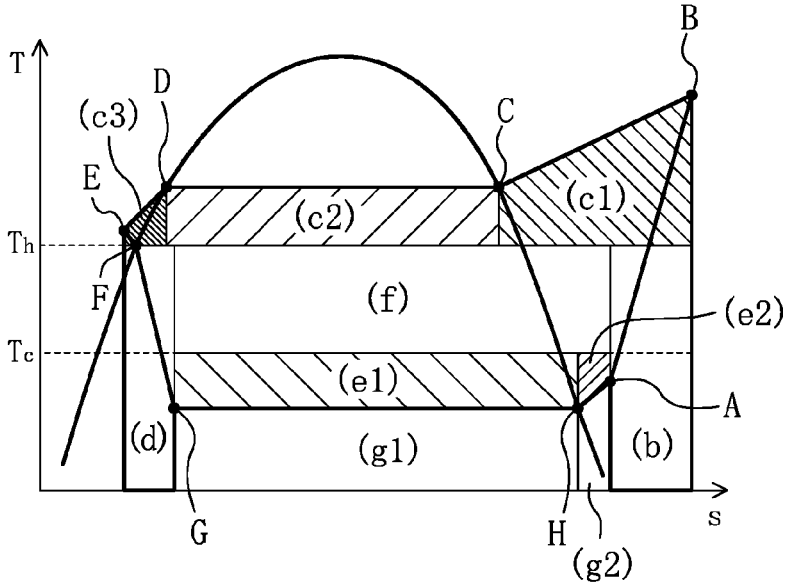
FIG. 7 A T-s graph showing regions to be used for the calculation of the leakage index value in a leakage diagnosis apparatus according to Variation 1 of the embodiment, wherein (A) shows the reference state and (B) shows the second progressive state.
Figure 7:
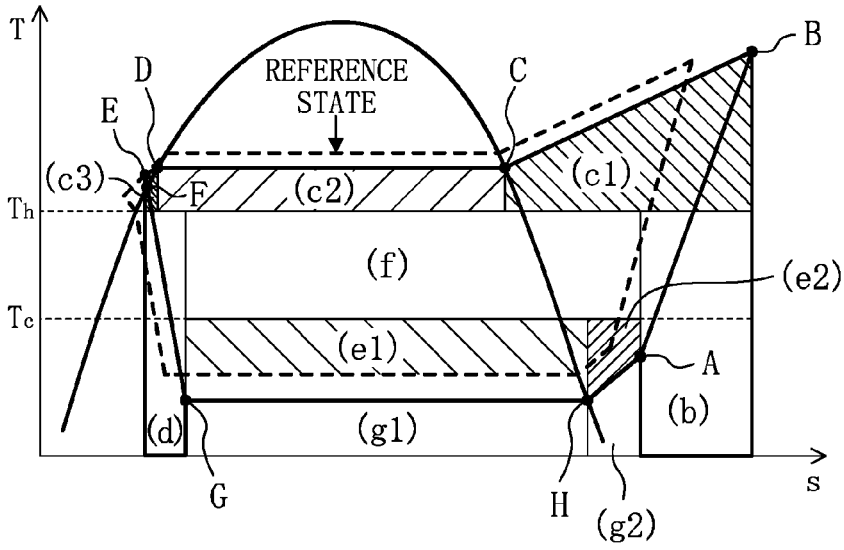

First, the leakage detection operation during the cooling operation will be described. In the leakage detection operation during the cooling operation, the process first performs the same first step as that of the embodiment. Then, in the second step, the exergy calculation section (52) calculates the amount of exergy loss ΔE(c2) during the process in which the refrigerant is in a two-phase gas/liquid state in the outdoor heat exchanger (34). In FIGS. 6 and 7, the amount of exergy loss ΔE(c2) during the process in which the refrigerant is in a two-phase gas/liquid state in the outdoor heat exchanger (34) is represented by the area of the region (c2). The exergy calculation section (52) calculates the amount of exergy loss ΔE(c2) during the process in which the refrigerant is in a two-phase gas/liquid state in the outdoor heat exchanger (34) by calculating the area of the region (c2) using the coordinate values of Point C and Point D and the measured value Th of the outdoor temperature sensor (18).

The exergy calculation section (52) calculates the amount of exergy loss ΔE(c3) during the process in which the refrigerant is in a single-phase liquid state in the outdoor heat exchanger (34). In FIGS. 6 and 7, the amount of exergy loss ΔE(c3) during the process in which the refrigerant is in a single-phase liquid state in the outdoor heat exchanger (34) is represented by the area of the region (c3). The exergy calculation section (52) calculates the amount of exergy loss ΔE(c3) during the process in which the refrigerant is in a single-phase liquid state in the outdoor heat exchanger (34) by calculating the area of the region (c3) using the coordinate values of Point D and Point E and the measured value Th of the outdoor temperature sensor (18).

The exergy calculation section (52) calculates the amount of exergy loss ΔE(e1) during the process in which the refrigerant is in a two-phase gas/liquid state in the indoor heat exchanger (37). In FIGS. 6 and 7, the amount of exergy loss ΔE(e1) during the process in which the refrigerant is in a two-phase gas/liquid state in the indoor heat exchanger (37) is represented by the area of the region (e1). The exergy calculation section (52) calculates the amount of exergy loss ΔE(e1) during the process in which the refrigerant is in a two-phase gas/liquid state in the indoor heat exchanger (37) by calculating the area of the region (e1) using the coordinate values of Point G and Point H and the measured value Tc of the indoor temperature sensor (19).

The exergy calculation section (52) calculates the amount of exergy loss ΔE(e2) during the process in which the refrigerant is in a single-phase gas state in the indoor heat exchanger (37). In FIGS. 6 and 7, the amount of exergy loss ΔE(e2) during the process in which the refrigerant is in a single-phase gas state in the indoor heat exchanger (37) is represented by the area of the region (e2). The exergy calculation section (52) calculates the amount of exergy loss ΔE(e2) during the process in which the refrigerant is in a single-phase gas state in the indoor heat exchanger (37) by calculating the area of the region (e2) using the coordinate values of Point H and Point A and the measured value Tc of the indoor temperature sensor (19).

Note that the amount of exergy loss ΔE(c2) during the process in which the refrigerant is in a two-phase gas/liquid state in the outdoor heat exchanger (34) represents the magnitude of the loss occurring when the refrigerant in the two-phase gas/liquid state flows. The amount of exergy loss ΔE(c3) during the process in which the refrigerant is in a single-phase liquid state in the outdoor heat exchanger (34) represents the magnitude of the loss occurring when the refrigerant in the single-phase liquid state flows. The amount of exergy loss ΔE(e1) during the process in which the refrigerant is in a two-phase gas/liquid state in the indoor heat exchanger (37) represents the magnitude of the loss occurring when the refrigerant in the two-phase gas/liquid state flows. The amount of exergy loss ΔE(e1) during the process in which the refrigerant is in a single-phase gas state in the indoor heat exchanger (37) represents the magnitude of the loss occurring when the refrigerant in the single-phase gas state flows.

Then, the exergy calculation section (52) calculates the ratio R1 (R1=ΔE(c3)/ΔE(c2)) of "the amount of exergy loss ΔE(c3) during the process in which the refrigerant is in a single-phase liquid state in the outdoor heat exchanger (34)" with respect to "the amount of exergy loss ΔE(c2) during the process in which the refrigerant is in a two-phase gas/liquid state in the outdoor heat exchanger (34)," and outputs the ratio R1, as the radiator-side index value. The exergy calculation section (52) calculates the ratio R2 (R2=ΔE(e2)/ΔE(e1)) of "the amount of exergy loss ΔE(e2) during the process in which the refrigerant is in a single-phase gas state in the indoor heat exchanger (37)" with respect to "the amount of exergy loss ΔE(e1) during the process in which the refrigerant is in a two-phase gas/liquid state in the indoor heat exchanger (37)," and outputs the ratio R2, as the evaporator-side index value. Thus, the second step ends.

Then, the process performs a third step of determining whether there is refrigerant leakage in the refrigerant circuit (20). Here, the memory of the leakage determination section (53) stores, as the fifth reference value, the reference-state value of the ratio of "the amount of exergy loss during the process in which the refrigerant is in a single-phase liquid state in the outdoor heat exchanger (34)" with respect to "the amount of exergy loss during the process in which the refrigerant is in a two-phase gas/liquid state in the outdoor heat exchanger (34)" during the cooling operation. The memory also stores, as the sixth reference value, the reference-state value of the ratio of "the amount of exergy loss during the process in which the refrigerant is in a single-phase gas state in the indoor heat exchanger (37)" with respect to "the amount of exergy loss during the process in which the refrigerant is in a two-phase gas/liquid state in the indoor heat exchanger (37)" during the cooling operation.

In the third step, first, the leakage determination section (53) reads out the fifth reference value and the sixth reference value from the memory. Then, the leakage determination section (53) calculates the rate of change of the radiator-side index value from the reference state by dividing the radiator-side index value by the fifth reference value. The leakage determination section (53) determines whether such a fifth judgment condition holds that the rate of change of the radiator-side index value from the reference state is less than or equal to a predetermined first judgment value. The leakage determination section (53) determines that there is refrigerant leakage in the refrigerant circuit (20) if the fifth judgment condition holds. On the other hand, the leakage determination section (53) determines that there is no refrigerant leakage in the refrigerant circuit (20) if the fifth judgment condition does not hold.

The leakage determination section (53) calculates the rate of change of the evaporator-side index value from the reference state by dividing the evaporator-side index value by the sixth reference value. The leakage determination section (53) determines whether such a sixth judgment condition holds that the rate of change of the evaporator-side index value from the reference state is greater than or equal to a predetermined second judgment value. The leakage determination section (53) determines that the refrigerant leakage has progressed to a predetermined level (such a level that circuit components may possibly be damaged due to refrigerant shortage) if the sixth judgment condition holds.

Note that in Variation 1, since a low-pressure constant control is performed during the cooling operation in which the operation frequency of the compressor (30) is controlled so that the low-pressure value of the refrigeration cycle (the detection value of the suction pressure sensor (46*a*)) is constant, there appears no substantial change in the amount of refrigerant exergy loss in the evaporator (34, 37) in the first progressive state in which the amount of refrigerant which has leaked from the refrigerant circuit (20) is relatively small. In the first progressive state, there appears a relatively substantial change in the amount of refrigerant exergy loss in the condenser (34, 37). Then, as the refrigerant leakage progresses, there appears a relatively substantial change also in the amount of refrigerant exergy loss in the evaporator (34, 37). Therefore, it is determined whether there is refrigerant leakage in the refrigerant circuit (20) based on the radiator-side index value, and it is determined whether the refrigerant leakage in the refrigerant circuit (20) has progressed to a predetermined level based on the evaporator-side index value.

However, where a high-pressure constant control, rather than a low-pressure constant control, is performed where the operation frequency of the compressor (30) is controlled so that the high-pressure value of the refrigeration cycle (the detection value of the discharge pressure sensor (46*b*)) is constant, there appears no substantial change in the amount of refrigerant exergy loss in the condenser (34, 37) and there appears a relatively substantial change in the amount of refrigerant exergy loss in the evaporator (34, 37) in the first progressive state. Then, when the refrigerant leakage progresses, there appears a relatively substantial change also in the amount of refrigerant exergy loss in the condenser (34, 37). In such a case, it is possible to determine whether there is refrigerant leakage in the refrigerant circuit (20) based on the evaporator-side index value, and determine whether the refrigerant leakage in the refrigerant circuit (20) has progressed to a predetermined level based on the radiator-side index value.

Next, a leakage detection operation during the heating operation will be described. In the leakage detection operation during the heating operation, the process first performs the same first step as that of the embodiment, as in the leakage detection operation during the cooling operation. Then, in the second step, the exergy calculation section (52) calculates the amount of exergy loss ΔE(e1) during the process in which the refrigerant is in a two-phase gas/liquid state in the outdoor heat exchanger (34). The exergy calculation section (52) calculates the amount of exergy loss ΔE(e2) during the process in which the refrigerant is in a single-phase gas state in the outdoor heat exchanger (34).

Then, the exergy calculation section (52) calculates the ratio R3 (R3=ΔE(e2)/ΔE(e1)) of "the amount of exergy loss ΔE(e2) during the process in which the refrigerant is in a single-phase gas state in the outdoor heat exchanger (34)" with respect to "the amount of exergy loss ΔE(e1) during the process in which the refrigerant is in a two-phase gas/liquid state in the outdoor heat exchanger (34)," and outputs the ratio R3, as the evaporator-side index value. Thus, the second step ends.

Then, the process performs a third step of determining whether there is refrigerant leakage in the refrigerant circuit (20). Here, the memory of the leakage determination section (53) stores, as the seventh reference value, the reference-state value of the ratio of "the amount of exergy loss during the process in which the refrigerant is in a single-phase gas state in the outdoor heat exchanger (34)" with respect to "the amount of exergy loss during the process in which the refrigerant is in a two-phase gas/liquid state in the outdoor heat exchanger (34)" during the heating operation.

In the third step, first, the leakage determination section (53) reads out the seventh reference value from the memory. Then, the leakage determination section (53) calculates the rate of change of the evaporator-side index value from the reference state by dividing the evaporator-side index value calculated in the second step by the seventh reference value. The leakage determination section (53) determines whether such a seventh judgment condition holds that the rate of change of the evaporator-side index value from the reference state is greater than or equal to a predetermined third judgment value. The leakage determination section (53) determines that there is refrigerant leakage in the refrigerant circuit (20) if the seventh judgment condition holds. On the other hand, the leakage determination section (53) determines that there is no refrigerant leakage in the refrigerant circuit (20) if the seventh judgment condition does not hold.

In Variation 1, the radiator-side index value is calculated without using the amount of exergy loss in the condenser (34, 37) during the process in which the refrigerant is in a single-phase gas state. Therefore, the calculation of the radiator-side index value does not require the temperature and the entropy of the refrigerant after the completion of the compression process. Therefore, the radiator-side index value can be calculated by using only relatively accurate values. Note that other than in Variation 1, the radiator-side index value may be calculated without using the amount of exergy loss during the process in which the refrigerant is in a single-phase gas state in the condenser (34, 37).

In Variation 1, since there appears a predetermined change in the ratio of "the amount of exergy loss during the process in which the refrigerant is in a single-phase liquid state in the condenser (34, 37)" with respect to "the amount of exergy loss during the process in which the refrigerant is in a two-phase gas/liquid state in the condenser (34, 37)" when there is refrigerant leakage in the refrigerant circuit (20), the ratio is used as the radiator-side index value and the refrigerant leakage diagnosis is performed based on the radiator-side index value. Since there appears a predetermined change in the ratio of "the amount of exergy loss during the process in which the refrigerant is in a single-phase gas state in the evaporator (34, 37)" with respect to "the amount of exergy loss during the process in which the refrigerant is in a two-phase gas/liquid state in the evaporator (34, 37)" when there is refrigerant leakage in the refrigerant circuit (20), the ratio is used as the evaporator-side index value and the refrigerant leakage diagnosis is performed based on the evaporator-side index value. The radiator-side index value and the evaporator-side index value are each ratios between amounts of exergy loss, and therefore are normalized values. Therefore, it is possible to perform refrigerant leakage diagnosis without taking into consideration the rated capacity of the refrigerant circuit (20). In Variation 1, the fifth to seventh reference values can be shared between refrigeration apparatuses (10) of different rated capacities.

Variation 2 of Embodiment

Variation 2 of the embodiment will be described. The leakage diagnosis apparatus (50) of Variation 2 uses the degree of opening of the indoor expansion valve (36*b*) and the degree of opening of the outdoor expansion valve (36*a*), in addition to the leakage index value, in order to determine whether there is refrigerant leakage. What is different from Variation 1 of the embodiment will now be described.

In the leakage detection operation during the cooling operation, in a third step, the leakage determination section (53) determines whether such a first opening condition holds that the degree of opening of the indoor expansion valve (36*b*) is greater than or equal to a predetermined first judgment degree of opening (e.g., about 1500 pulses). The leakage determination section (53) determines that there is refrigerant leakage in the refrigerant circuit (20) when the first opening condition holds even if the sixth judgment condition does not hold (where it cannot be determined that there is refrigerant leakage based on the evaporator-side index value). Note that the first judgment degree of opening is a value larger than the degree of opening of the indoor expansion valve (36*b*) that is expected in a state where there is no refrigerant leakage (a value around 500 pulses), and is a value that cannot be reached in a state where there is no refrigerant leakage.

Here, where superheat degree control is performed in which the degree of opening of the indoor expansion valve (36*b*) is adjusted so that the degree of superheat of the refrigerant flowing out of the indoor heat exchanger (37) is constant, there is substantially no change in the degree of superheat of the refrigerant flowing out of the indoor heat exchanger (37) in a state where the amount of refrigerant which has leaked from the refrigerant circuit (20) is relatively small. Therefore, there is substantially no change in the evaporator-side index value. On the other hand, when the refrigerant flowing through the indoor heat exchanger (37)

decreases due to refrigerant leakage, the degree of opening of the indoor expansion valve (36*b*) increases so that the degree of superheat of the refrigerant flowing out of the indoor heat exchanger (37) does not increase. That is, when there is refrigerant leakage, there appears a change in the degree of opening of the expansion valve (36) earlier than in the evaporator-side index value. Variation 2 focuses on this point, and determines that there is refrigerant leakage when the degree of opening of the indoor expansion valve (36*b*) is greater than or equal to a first judgment degree of opening even if it cannot be determined that there is refrigerant leakage based on the evaporator-side index value. Therefore, it is possible to detect refrigerant leakage at a stage where the amount of refrigerant which has leaked from the refrigerant circuit (20) is still small.

In the leakage detection operation during the heating operation, in the third step, the leakage determination section (53) determines whether such a second opening condition holds that the degree of opening of the outdoor expansion valve (36*a*) is greater than or equal to a predetermined second judgment degree of opening (e.g., 400 pulses). The leakage determination section (53) determines that there is refrigerant leakage in the refrigerant circuit (20) when the second opening condition holds even if the seventh judgment condition does not hold (where it cannot be determined that there is refrigerant leakage based on the evaporator-side index value). Note that the second judgment degree of opening is a value larger than the degree of opening (50-100 pulses) of the outdoor expansion valve (36*a*) that is expected in a state where there is no refrigerant leakage, and is a value that cannot be reached in a state where there is no refrigerant leakage.

In Variation 2, it is determined that there is refrigerant leakage when the degree of opening of the outdoor expansion valve (36*a*) is greater than or equal to a second judgment degree of opening even if it cannot be determined that there is refrigerant leakage based on the evaporator-side index value during the heating operation. Therefore, it is possible to detect refrigerant leakage at a stage where the amount of refrigerant which has leaked from the refrigerant circuit (20) is still small.

Note that it is possible to use the degree of opening of the indoor expansion valve (36*b*) in order to determine whether there is refrigerant leakage during the heating operation. In such a case, in the second step, the exergy calculation section (52) calculates the ratio of "the amount of exergy loss during the process in which the refrigerant is in a single-phase liquid state in the indoor heat exchanger (37)" with respect to "the amount of exergy loss during the process in which the refrigerant is in a two-phase gas/liquid state in the indoor heat exchanger (37)" as the radiator-side index value. Then, in the third step, the leakage determination section (53) determines whether such an eighth judgment condition holds that the rate of change of the radiator-side index value from the reference state is less than or equal to a predetermined fourth judgment value. The leakage determination section (53) determines that there is refrigerant leakage in the refrigerant circuit (20) if the eighth judgment condition holds.

Then, in the third step, the leakage determination section (53) determines whether such a third opening condition holds that the degree of opening of the indoor expansion valve (36*b*) is less than or equal to a predetermined third judgment degree of opening (e.g., 100 pulses). The leakage determination section (53) determines that there is refrigerant leakage in the refrigerant circuit (20) when the third opening condition holds even if the eighth judgment condition does not hold (where it cannot be determined that there is refrigerant leakage based on the radiator-side index value). Note that the third judgment degree of opening is a value smaller than the degree of opening of the indoor expansion valve (36*b*) (a value around 500 pulses) that is expected in a state where there is no refrigerant leakage, and is a value that cannot be reached in a state where there is no refrigerant leakage.

Where subcooling degree control is performed in which the degree of opening of the indoor expansion valve (36*b*) is adjusted so that the degree of subcooling of the refrigerant flowing out of the indoor heat exchanger (37) is constant, there is substantially no change in the degree of subcooling of the refrigerant flowing out of the indoor heat exchanger (37) in a state where the amount of refrigerant which has leaked from the refrigerant circuit (20) is relatively small. Therefore, there is substantially no change in the radiator-side index value. On the other hand, when the refrigerant flowing through the indoor heat exchanger (37) decreases due to refrigerant leakage, the degree of opening of the indoor expansion valve (36*b*) decreases so that the degree of subcooling of the refrigerant flowing out of the indoor heat exchanger (37) does not decrease. Variation 2 focuses on this point, and determines that there is refrigerant leakage when the degree of opening of the indoor expansion valve (36*b*) is less than or equal to a third judgment degree of opening even if it cannot be determined that there is refrigerant leakage based on the radiator-side index value. Therefore, it is possible to detect refrigerant leakage at a stage where the amount of refrigerant which has leaked from the refrigerant circuit (20) is still small.

Variation 3 of Embodiment

Variation 3 of the embodiment will be described. The leakage diagnosis apparatus (50) of Variation 2 differs from the embodiment in terms of the method for determining whether the refrigerant leakage in the refrigerant circuit (20) has progressed to a predetermined level.

In the second step, during the cooling operation, the exergy calculation section (52) calculates the ratio R ($R=\Delta E(c)/\Delta E(e)$) of "the amount of refrigerant exergy loss $\Delta E(c)$ in the outdoor heat exchanger (34)" with respect to "the amount of refrigerant exergy loss $\Delta E(e)$ in the indoor heat exchanger (37)," and outputs the ratio R, as the leakage index value.

Here, the leakage determination section (53) stores, as the eighth reference value, the reference-state value of the ratio of "the amount of refrigerant exergy loss in the outdoor heat exchanger (34)" with respect to "the amount of refrigerant exergy loss in the indoor heat exchanger (37)" during the cooling operation. In the third step, the leakage determination section (53) reads out the eighth reference value from the memory. Then, the leakage determination section (53) calculates the rate of change of the leakage index value from the reference state by dividing the leakage index value calculated in the second step by the eighth reference value. The leakage determination section (53) determines whether such an eighth judgment condition holds that the rate of change of the leakage index value from the reference state is less than or equal to a predetermined fifth judgment value. The leakage determination section (53) determines that the refrigerant leakage in the refrigerant circuit (20) has progressed to a predetermined level if the eighth judgment condition holds.

Here, where low-pressure constant control is performed in which the refrigerant circuit (20) is controlled so that the low pressure of the refrigeration cycle is constant, if there is refrigerant leakage, the amount of refrigerant exergy loss in the outdoor heat exchanger (34) decreases along with the decrease in the high pressure of the refrigeration cycle whereas the amount of refrigerant exergy loss in the indoor heat exchanger (37) does not change substantially. Therefore, there appears a predetermined change in the ratio of "the amount of refrigerant exergy loss in the condenser (34, 37)" with respect to "the amount of refrigerant exergy loss in the evaporator (34, 37)." Similarly, where high-pressure constant control is performed in which the refrigerant circuit (20) is controlled so that the high pressure of the refrigeration cycle is constant, there appears a predetermined change in the ratio of "the amount of refrigerant exergy loss in the condenser (34, 37)" with respect to "the amount of refrigerant exergy loss in the evaporator (34, 37)."

Therefore, in Variation 3, the ratio of "the amount of refrigerant exergy loss in the condenser (34, 37)" with respect to "the amount of refrigerant exergy loss in the evaporator (34, 37)" is used as the leakage index value, and refrigerant leakage diagnosis is performed based on the leakage index value. The leakage index value is a ratio between amounts of exergy loss, and therefore is a normalized value. Therefore, it is possible to perform refrigerant leakage diagnosis without taking into consideration the rated capacity of the refrigerant circuit (20).

Other Embodiments

The embodiment may be configured as shown in the following variations.

—First Variation—

With the embodiment, the leakage determination section (53) may be configured so as not to determine that there is refrigerant leakage in the refrigerant circuit (20) when the difference between the degree of superheat of the refrigerant flowing into the accumulator (38) and the degree of superheat of the refrigerant flowing out of the accumulator (38) is greater than or equal to a predetermined suction-side reference value even if it can be determined that there is refrigerant leakage in the refrigerant circuit (20) based on the leakage index value.

Here, the amount of refrigerant which accumulates in the accumulator (38) increases when the air-conditioning load decreases, for example. However, even if the operation capacity of the compressor (30) increases after the amount of refrigerant which accumulates in the accumulator (38) increases, it takes time for the amount of refrigerant in the accumulator (38) to decrease. Therefore, the amount of refrigerant circulating in the refrigerant circuit (20) is insufficient until the amount of refrigerant in the accumulator (38) decreases, and such a state may possibly be determined erroneously as refrigerant leakage. In the first variation, in order to prevent such erroneous determination, the process determines that a relatively large amount of refrigerant is accumulated in the accumulator (38) and does not determine that there is refrigerant leakage when the difference between the degree of superheat of the refrigerant flowing into the accumulator (38) and the degree of superheat of the refrigerant flowing out of the accumulator (38) is greater than or equal to a predetermined suction-side reference value even if it can be determined that there is refrigerant leakage based on the leakage index value. Thus, it is possible to suppress erroneous determination of a state where a relatively large amount of refrigerant is accumulated in the accumulator (38) as being refrigerant leakage.

Note that in the refrigerant circuit (20), an inlet temperature sensor (17) is provided along a refrigerant pipe that connects to the inlet of the accumulator (38) as shown in FIG. 5. During the cooling operation, the leakage determination section (53) calculates a value obtained by subtracting the measured value of the suction temperature sensor (45*a*) from the measured value of the inlet temperature sensor (17), for example, as the difference between the degree of superheat of the refrigerant flowing into the accumulator (38) and the degree of superheat of the refrigerant flowing from the accumulator (38) toward the compressor (30).

—Second Variation—

Figure 8:
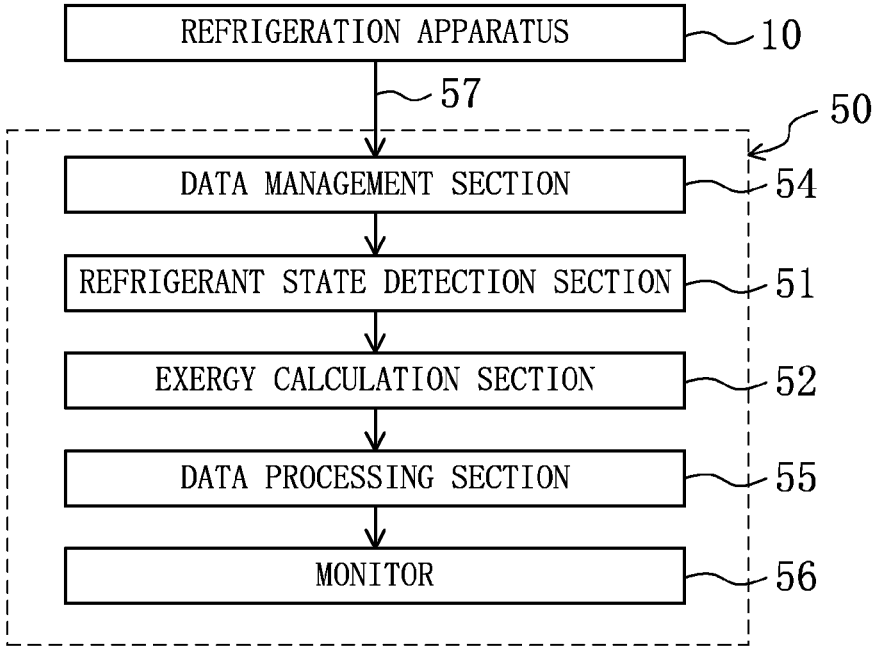
FIG. 8 A block diagram of a leakage diagnosis apparatus according to a second variation of an alternative embodiment.

With the embodiment, the leakage diagnosis apparatus (50) may include a data processing section (55) for averaging the leakage index value output from the exergy calculation section (52) as shown in FIG. 8. In the second variation, the leakage diagnosis apparatus (50) is placed at a location away from the refrigeration apparatus (10). The leakage diagnosis apparatus (50) is connected to a control substrate provided in the refrigeration apparatus (10) through a network (57), for example. The leakage diagnosis apparatus (50) is provided with a data management section (54) to which measured values of all the temperature sensors (16-19, 45, 63) and the pressure sensor (46) provided in the refrigeration apparatus (10) are input via the control substrate.

The refrigerant state detection section (51) detects the temperature and the entropy of the refrigerant at positions of the inlet of the compressor (30), the outlet of the compressor (30), the inlet of the expansion valve (36) and the outlet of the expansion valve (36) by using the measured values of the temperature sensors (16-19, 45, 63) and the pressure sensor (46) input to the data management section (54) as in the embodiment.

The exergy calculation section (52) calculates the leakage index value as in the embodiment. The exergy calculation section (52) calculates the leakage index value and outputs the leakage index value to the data processing section (55) once per day, for example. The exergy calculation section (52) calculates, as the leakage index value, the ratio of "the amount of exergy loss $\Delta E(c3)$ during the process in which the refrigerant is in a single-phase liquid state in the outdoor heat exchanger (34)" with respect to "the amount of exergy loss $\Delta E(c2)$ during the process in which the refrigerant is in a two-phase gas/liquid state in the outdoor heat exchanger (34)," for example.

Figure 9:
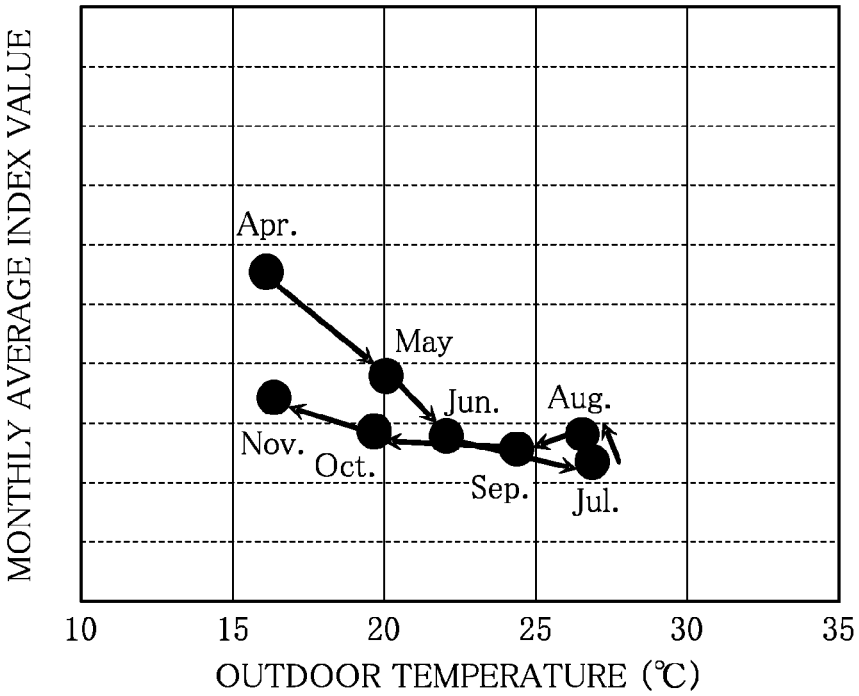
FIG. 9 A graph showing an example of monthly average index values output by the leakage diagnosis apparatus according to the second variation of the alternative embodiment.

Data of the leakage index value is accumulated in the data processing section (55). The data processing section (55) averages the accumulated leakage index values month by month, for example, to produce a graph shown in FIG. 9. A monitor (56) of the leakage diagnosis apparatus (50) displays the graph produced by the data processing section (55) as information for leakage diagnosis. The leakage index values averaged by the unit of months (hereinafter referred to as "monthly average index values") are visualized.

Figure 10:
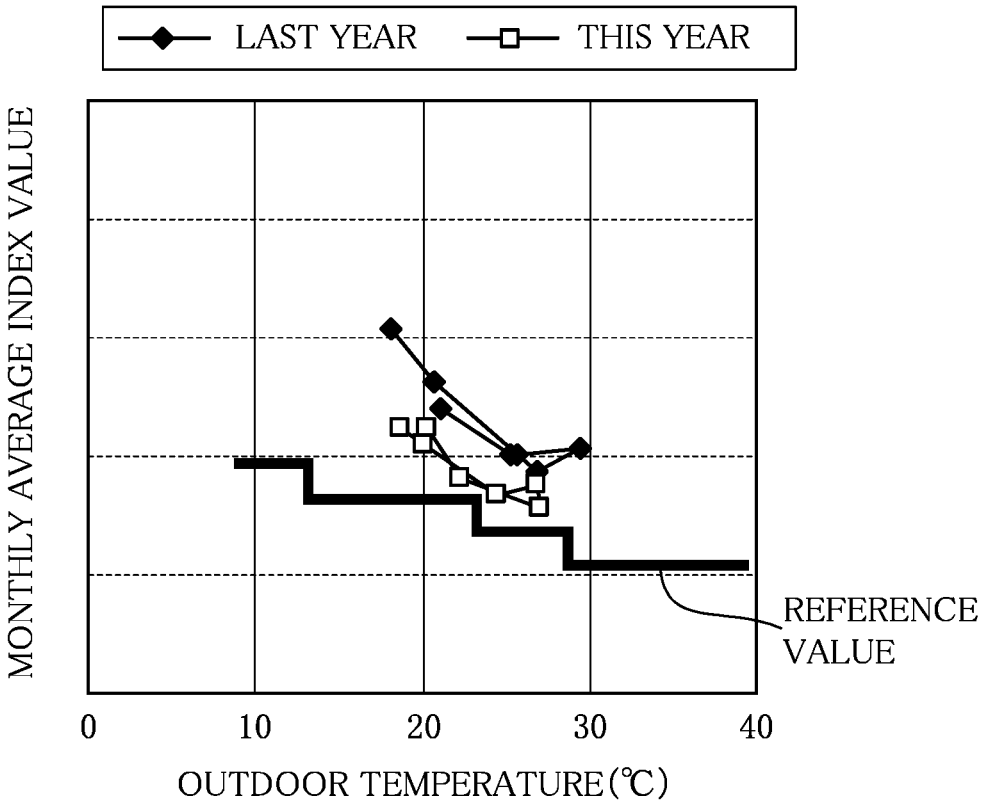
FIG. 10 A graph showing another example of monthly average index values output by the leakage diagnosis apparatus according to the second variation of the alternative embodiment.

Therefore, where the monthly average index values of a certain year are lower than those of the respective months of the year before as shown in FIG. 10, for example, the person who takes care of the refrigeration apparatus (10) looking at the monitor (56) can grasp that the monthly average index value is decreasing as a whole and thus determine that there is refrigerant leakage.

Note that instead of a human making the judgment on refrigerant leakage, the leakage determination section (53) can determine whether there is refrigerant leakage in the refrigerant circuit (20) by comparing the trend of the monthly average index values of a certain year with that of the year before.

The leakage determination section (53) may determine whether there is refrigerant leakage in the refrigerant circuit (20) by comparing the monthly average index value with a predetermined reference value. In such a case, since the monthly average index value varies from month to month, the reference value may be set to larger values for months in which the monthly average index value is expected to be larger as shown in FIG. 10.

For example, the monthly average index value may be below the reference value even immediately after the refrigeration apparatus (10) is installed. In such a case, one can assume that there is not sufficient refrigerant not because of refrigerant leakage but because the refrigerant circuit (20) was not charged with a sufficient amount of refrigerant when installing the refrigeration apparatus (10).

—Third Variation—

With the embodiment, the refrigeration apparatus (10) is not limited to the air conditioner apparatus (10), but may also be a refrigeration apparatus (10) for cooling the inside of the refrigeration apparatus for refrigerating or freezing food items, a refrigeration apparatus (10) for cooling/heating the room and for cooling the inside of the refrigeration apparatus, a refrigeration apparatus (10) with humidity control function in which the heat of refrigerant circulating through a heat exchanger is used for heating or cooling an adsorbent, or a refrigeration apparatus (10) with water heater function in which water is heated with high-pressure refrigerant.

—Fourth Variation—

With the embodiment, the refrigeration apparatus (10) may be configured to perform a supercritical cycle in which the high pressure of the refrigeration cycle is higher than the supercritical pressure of the refrigerant. In such a case, a heat exchanger which serves as a condenser in a normal refrigeration cycle in which the high pressure of the refrigeration cycle is lower than the supercritical pressure of the refrigerant serves as a radiator (gas cooler). The refrigerant may be, for example, carbon dioxide.

Note that the embodiments described above are essentially preferred embodiments, and are not intended to limit the scope of the present invention, the applications thereof, or the uses thereof.

INDUSTRIAL APPLICABILITY

As described above, the present invention is useful as a leakage diagnosis apparatus and a leakage diagnosis method for diagnosing presence/absence of refrigerant leakage from a refrigerant circuit, and as a refrigeration apparatus having such a leakage diagnosis apparatus.

DESCRIPTION OF REFERENCE CHARACTERS

10 Air conditioner apparatus (refrigeration apparatus)
20 Refrigerant circuit
30 Compressor
34 Outdoor heat exchanger (radiator, evaporator)
36 Expansion valve (depressurization mechanism)
37 Indoor heat exchanger (radiator, evaporator)
50 Leakage diagnosis apparatus
51 Refrigerant state detection section (index value calculation means)
52 Exergy calculation section (index value calculation means)
53 Leakage determination section (leakage determination means)

The invention claimed is:

1. A leakage diagnosis apparatus for diagnosing presence/absence of refrigerant leakage in a refrigerant circuit including a compressor, a radiator, a depressurization mechanism and an evaporator provided as circuit components thereof and performing a refrigeration cycle by circulating refrigerant therethrough, comprising:

an index value calculator for calculating for calculating a radiator-side index value which changes in accordance with an amount of refrigerant leaking out of the refrigerant circuit based on an amount of refrigerant exergy loss in the radiator; and a leakage determinator for determining whether there is refrigerant leakage in the refrigerant circuit based on the radiator-side index value calculated by the index value calculator, wherein the index value calculator calculates, as the radiator-side index value, a ratio of one of an amount of exergy loss during a process in which the refrigerant is in a two-phase gas/liquid state in the radiator and an amount of exergy loss during a process in which the refrigerant is in a single-phase liquid state in the radiator with respect to the other.

2. The leakage diagnosis apparatus of claim 1, wherein in the refrigerant circuit, the depressurization mechanism is formed by an expansion valve whose degree of opening is variable, and the degree of opening of the expansion valve is adjusted so that a degree of subcooling of the refrigerant flowing out of the radiator is constant, and the leakage determinator determines that there is refrigerant leakage in the refrigerant circuit when the degree of opening of the expansion valve is less than or equal to a predetermined judgment degree of opening even if it cannot be determined that there is refrigerant leakage in the refrigerant circuit based on the radiator-side index value.

3. A leakage diagnosis apparatus for diagnosing presence/absence of refrigerant leakage in a refrigerant circuit including a compressor, a radiator, a depressurization mechanism and an evaporator provided as circuit components thereof and performing a refrigeration cycle by circulating refrigerant therethrough, comprising:

an index value calculator for calculating an evaporator-side index value which changes in accordance with an amount of refrigerant leaking out of the refrigerant circuit based on an amount of refrigerant exergy loss in the evaporator; and a leakage determinator for determining whether there is refrigerant leakage in the refrigerant circuit based on the evaporator-side index value calculated by the index value calculator.

4. The leakage diagnosis apparatus of claim 3, wherein the index value calculator calculates, as the evaporator-side index value, a ratio of one of an amount of exergy loss during a process in which a refrigerant is in a two-phase gas/liquid state in the evaporator and an amount of exergy loss during a process in which the refrigerant is in a single-phase gas state in the evaporator with respect to the other.

5. The leakage diagnosis apparatus of claim 4, wherein in the refrigerant circuit, the depressurization mechanism is formed by an expansion valve whose degree of opening is variable, and the degree of opening of the expansion valve is adjusted so that a degree of superheat of the refrigerant flowing out of the evaporator is constant, and the leakage that there is refrigerant leakage in the refrigerant circuit when the degree of opening of the expansion valve is greater than or equal to a predetermined judgment degree of opening even if it cannot be determined that there is refrigerant leakage in the refrigerant circuit based on the evaporator-side index value.

6. A leakage diagnosis apparatus for diagnosing presence/absence of refrigerant leakage in a refrigerant circuit including a compressor, a radiator, a depressurization mechanism and an evaporator provided as circuit components thereof and performing a refrigeration cycle by circulating refrigerant therethrough, comprising:

an index value calculator for calculating a leakage index value which changes in accordance with an amount of refrigerant leaking out of the refrigerant circuit based on an amount of refrigerant exergy loss in a circuit component; and a leakage determinator for determining whether there is refrigerant leakage in the refrigerant circuit based on the leakage index value calculated by the index value calculator, wherein an accumulator for separating liquid refrigerant from refrigerant sucked into the compressor is provided in the refrigerant circuit, and the leakage determinator does not determine that there is refrigerant leakage in the refrigerant circuit when a difference between a degree of superheat of the refrigerant flowing into the accumulator and a degree of superheat of the refrigerant flowing out of the accumulator is greater than or equal to a predetermined suction-side reference value even if it can be determined that there is refrigerant leakage in the refrigerant circuit based on the leakage index value.

* * * * *